US007740056B2

(12) United States Patent
Watanabe

(10) Patent No.: US 7,740,056 B2
(45) Date of Patent: Jun. 22, 2010

(54) OUTER SHELL STRUCTURE FOR A HEAT EXCHANGER

(75) Inventor: Taro Watanabe, Tokyo (JP)

(73) Assignee: Xenesys, Inc., Hyogo-Ken (JP)

( * ) Notice: Subject to any disclaimer, the term of this patent is extended or adjusted under 35 U.S.C. 154(b) by 1142 days.

(21) Appl. No.: 11/368,611

(22) Filed: Mar. 7, 2006

(65) Prior Publication Data

US 2006/0201660 A1 Sep. 14, 2006

(30) Foreign Application Priority Data

Mar. 8, 2005 (JP) ..... P2005-064005

(51) Int. Cl.
*F28D 7/10* (2006.01)
*F28F 9/02* (2006.01)

(52) U.S. Cl. ..... 165/157; 165/173; 165/166

(58) Field of Classification Search ..... 165/157, 165/165, 166, 168, 170, 173
See application file for complete search history.

(56) References Cited

U.S. PATENT DOCUMENTS 4,183,402 A * 1/1980 Cotter ..... 165/175
5,228,515 A * 7/1993 Tran ..... 165/166
5,661,906 A * 9/1997 Beier et al. ..... 29/890.039
6,293,337 B1 * 9/2001 Strahle et al. ..... 165/166
6,516,874 B2 * 2/2003 Mathur et al. ..... 165/166
7,121,330 B2 * 10/2006 Matsuzaki ..... 165/165
2006/0219394 A1 * 10/2006 Martin et al. ..... 165/157

FOREIGN PATENT DOCUMENTS

JP 03-091695 A 4/1991

* cited by examiner

*Primary Examiner*—Tho V Duong
(74) *Attorney, Agent, or Firm*—Rader, Fishman & Grauer PLLC

(57) ABSTRACT

An outer shell structure surrounds a heat exchange unit formed of plates, which has first to third pairs of opposite planes. The structure has opposite end walls, opposite first walls and opposite second walls, and gap closure members. The end walls are placed on the pair of first opposite planes of the heat exchange unit. The first walls having openings are placed outside apart from the pair of second opposite planes of the heat exchange unit and connected water-tightly to edges of the end walls. The second walls having openings are placed outside apart from the pair of third opposite planes of the heat exchange unit and connected water-tightly to edges of the end walls. The gap closure members close a gap between the first walls and the heat exchange unit and a gap between the second walls and the heat exchange unit.

18 Claims, 22 Drawing Sheets

OUTER SHELL STRUCTURE FOR A HEAT EXCHANGER

BACKGROUND OF THE INVENTION

1. Field of the Invention

The present invention relates to a heat exchanger utilizing a heat exchange unit into which a plurality of heat exchange plates formed of a metallic plate are combined, and especially, to an outer shell structure for such a heat exchanger, that has the minimum structural parts with which the heat exchange unit is surrounded to provide a compact structure to ensure a proper operational state of heat exchange fluids.

2. Description of the Related Art

If there is a demand that heat transfer coefficient is increased to enhance heat exchange efficiency, utilizing a heat exchanger by which transfer of heat (i.e., heat exchange) is made between a high temperature fluid and a low temperature fluid, a plate-type heat exchanger has conventionally been used widely. The plate-type heat exchanger has a structure in which a plurality of heat transfer plates are placed parallelly one upon another at prescribed intervals so as to form passages, which are separated by means of the respective heat transfer plates. A high temperature fluid and a low temperature fluid flow alternately in the above-mentioned passages to make heat exchange through the respective heat transfer plates. Japanese Patent Provisional Publication No. H3-91695 describes an example of such a conventional plate-type heat exchanger.

In the conventional plate-type heat exchanger, gasket members formed of elastic material are placed between the adjacent two plates to make the distance between them constant and define passages for fluid. However, a high pressure of the heat exchange fluid flowing between the plates may cause deformation of the gasket member, thus disabling an appropriate separation of the fluids from being ensured or leading to an unfavorable variation in distance between the plates. In such a case, an effective heat exchange may not be carried out, thus causing a problem. In view of these facts, the conventional heat exchanger involves a problem that the heat exchange fluids can be utilized only in a pressure range in which the gasket member withstands.

There has recently been proposed a heat exchanger having a structure in which metallic thin plates, which are placed at predetermined intervals, are joined together, without using any gasket members, at their ends by welding to assemble the plates into a single unit so as to form passages for heat exchange fluids, on the opposite sides of the respective plates. For example, Japanese Patent Provisional Publication No. S60-238697 describes such a heat exchanger.

The conventional heat exchanger is composed of a block body into which a plurality of plates each having edges bent at right angles are combined and welded together, and lateral walls for circulation chambers for fluids. These plates are combined together by butt-welding adjacent two plates to each other at opposite side edges thereof to prepare a combined body, and then butt-welding such a combined body and the other plate at the other opposite sides thereof, and repeating such a butt-welding operation. In addition, vertical edges projecting at each corner of the block body are directly secured to the lateral walls for forming the fluid circulation chambers, which serve as an outer shell for the heat exchanger, or secured thereto through upstanding members having rigidity, thus ensuring a state in which opening portions defined by the respective plate of the block body are separated from each other.

In the above-mentioned conventional heat exchanger, two kinds of fluids, which are to be subjected to heat exchange, flow separately from each other by means of the plates based on a cross flowing system in which flowing directions of these fluids intersect. In addition, the passage extends in a direction from one side to the other side of the plate and then turns back to the one side in the reverse direction and repeats such extension for each of a plural sets of plates as combined, thus providing an artificial flowing relationship based on a counter-flowing system or a parallel flowing system.

Japanese Patent Provisional Publication No. H3-91695 and Japanese Patent Provisional Publication No. S60-238697 describe the structure of the above-mentioned conventional heat exchanger. According to the conventional heat exchanger described in Japanese Patent Provisional Publication No. S60-238697, the plates are welded together, thus permitting to cope with heat exchange fluids having a high pressure. However, the passage extends in the direction from one side to the other side of the plate and then turns back to the one side in the reverse direction and repeats such extension, leading to a larger loss and deteriorated heat exchange efficiency in comparison with a heat exchanger having a flowing relationship in which fluids flow based on a true counter-flowing or parallel flowing system, separately from each other by means of the plates. In addition, the complicated structure of the flowing passages make such a heat exchanger unsuitable for heat exchange of gas-liquid two phase fluids, thus causing problems. Further, existence of the vertical edges for securing the sets of plates to the lateral walls requires formation of tongue portions on blank plate prior to the press formation process so as to project at corners. When a shearing process is applied to a metallic plate having a rectangular shape, useless portions thereof are usually produced, thus causing an additional problem.

Each of the conventional heat exchangers that have a structure in which plates are welded together and include an example disclosed in Japanese Patent Provisional Publication No. S60-238697 is provided on the outer side of the heat exchange unit (block) into which the plates are combined with a firm box-type shell (a pressure-resistant vessel) so as to form gaps serving as passages through which heat exchange fluids flow, between the heat exchange unit and the shell, thus preventing the fluids having high pressure from leaking out of the heat exchanger. Existence of a space for forming the passages around the unit and the box-type shell makes the whole heat exchanger considerably larger than the unit, thus causing a problem of difficulty in making the heat exchanger compact. In addition, the heat exchanger has the heat exchange unit into which there are combined the plates having a rectangular shape in which the opposite parallel sides thereof are considerably longer than the other opposite parallel sides thereof. When an inlet and an outlet of the shell for the heat exchanger, which communicate with openings provided on the longer side of the heat exchange unit, are spaced apart from each other by a long distance, the gap that is formed right outside the heat exchange unit so as to extend along the longer side thereof causes the fluid flowing from the inlet to the outlet to bypass the gaps having a high flowing resistance to directly flow into the gaps having a low flowing resistance. As a result, the fluid does not flow in the greater part of the passages through which it should flow, thus disabling a proper heat exchange relative to the other fluid from being made.

SUMMARY OF THE INVENTION

An object of the present invention, which was made to solve the above-mentioned problems, is therefore to provide an outer shell structure for a heat exchanger, which permits to provide an optimized combination of shell sections with which a heat exchange unit is surrounded, combine easily the shell sections and the unit to make the heat exchanger compact and reduce the number of parts, ensure an appropriate separation of the different passages for fluids, cope with the heat exchange fluids having high pressure, and cause the heat exchange fluids to flow the passages between the plates in a reliable manner, while improving flexibility in setting of a layout of inlet and outlet for the heat exchange fluids and of a flowing relationship.

In order to attain the aforementioned object, an outer shell structure for a heat exchanger of the first aspect of the present invention, with which a heat exchange unit having a plurality of heat exchange plates formed of a square or rectangular metallic plate is surrounded, the heat exchange plates being placed in parallel with each other so that there are repeated a first connecting relationship in which external surfaces of adjacent two heat exchange plates face each other and welded together at a first pair of side edges thereof over an entire length thereof to form a first gap portion therebetween and a second connecting relationship in which internal surfaces of other adjacent two heat exchange plates face each other and welded together at a second pair of side edges thereof rectangular to the first pair of side edges over an entire length thereof excepting welded portions of the first pair of side edges to form a second gap portion therebetween, so as to provide a combined body for the heat exchange unit, having a pair of first opposite planes that are in parallel with the heat exchange plates, a pair of second opposite planes that are placed on opening sides of the first gap portion and a pair of third opposite planes that are placed on opening sides of the second gap portion, the outer shell structure ensuring separate flow of a first heat exchange fluid flowing through the first gap portion and a second heat exchange fluid flowing through the second gap portion and preventing external leakage of the first and second heat exchange fluids, the outer shell structure comprises: a pair of opposite end walls placed on the pair of first opposite planes of the heat exchange unit, respectively, so as to cover the pair of first opposite planes thereof, a pair of opposite first walls with an opening placed outside apart from the pair of second opposite planes of the heat exchange unit, respectively, the first walls with an opening being connected water-tightly to edges of the end walls so as to isolate an opening of the first gap portion from an outside, except for an inlet and an outlet for the first heat exchange fluid; a pair of opposite second walls with an opening placed outside apart from the pair of third opposite planes of the heat exchange unit, respectively, the second walls with an opening being connected water-tightly to edges of the end walls so as to isolate an opening of the second gap portion from the outside, except for an inlet and an outlet for the second heat exchange fluid; and one or more gap closure member for closing at least partially, of a gap between the first walls with an opening and the heat exchange unit and/or a gap between the second walls with an opening and the heat exchange unit, other regions than the inlet and outlet for each of the first and second heat exchange fluids, to disable the heat exchange fluid from flowing in a direction along which the gap portion extends, in parallel with a side of the heat exchange plates.

According to the first aspect of the present invention, there are provided the end walls placed respectively on the first opposite planes of the heat exchange unit into which the heat exchange plates are placed in parallel with each other and welded together at the opposite edges thereof, the opposite first walls with an opening for covering the openings of the first gap portions and the opposite second walls with an opening for covering the openings of the second gap portions, and the end walls, the opposite first walls with an opening and the opposite second walls with an opening are connected to each other so as to surround the heat exchange unit. It is therefore possible to separate reliably the heat exchange unit from an outside through a simple structure in which the heat exchange unit is surrounded with the end walls and the first and second walls with an opening firmly secured to each other at corners of the heat exchange unit. The heat exchanger can therefore be composed of the heat exchange unit and the minimum number of outer shell sections, without upsizing the heat exchanger, thus permitting to make the heat exchanger compact. In addition, the gaps between the first and/or second walls with an opening and the heat exchange unit are at least partially closed by means of the gap closure members, thus preventing the heat exchange fluids from flowing into the gap portions. Even when an inlet and an outlet formed on the respective walls are spaced apart from each other by a long distance in the direction of the plane of the unit on the side of which these inlet and outlet are placed, it is possible to cause the fluid to flow between the plates, thus making heat exchange relative to the other kind of heat exchange fluid.

The outer shell structure according to the second aspect of the present invention may further comprise four sets of corner ridge members welded to the opposite end walls and the heat exchange plates, each of the corner ridge members comprising an outer plate section and an inner plate section, each of the outer and inner plate sections being provided at a longitudinal side thereof with a serration portion having serrations that are formed at same intervals as the heat exchange plates aligned with a same orientation of the plurality of heat exchange plates, the serration portion of the outer plate section being inserted into gaps between a plural pairs of heat exchange plates that are welded together at the first pair of side edges thereof over the entire length thereof, of the heat exchange unit, and the serration portion of the inner plate section being inserted into the first gap portions by a predetermined length; and the end walls being connected water-tightly to opposite end portions of each of the corner ridge members in a direction along which the heat exchange plates are placed.

According to the second aspect of the present invention, the outer and inner plate sections with the serration portions having the corresponding shapes to the inner and outer sides of the edges, which define the first gap portions are welded to the heat exchange unit together with the heat exchange plates to provide the corner ridge members connected to the heat exchange unit. In addition, the end walls are connected to the corner ridge members to provide a structure in which the heat exchange unit is surrounded with the end walls and the first and second walls with an opening, utilizing the corner ridge members firmly secured to the heat exchange unit, as a basic body. It is therefore possible to separate reliably the openings of the first gap portions and the openings of the second gap portions through the corner ridge members placed therebetween to remarkably enhance connection strength between the heat exchange plates as combined into a unit, through the connection to the corner ridge members, thus permitting to cope with a case of a large difference in pressure between the heat exchange fluids. Further, the heat exchange unit is connected through the corner ridge members to the other members serving as the outer shell sections, with the result that there is no need to form any projections for connection on the side of the heat exchange unit. Accordingly, blank plates having the simple rectangular shape can be used to prepare the heat exchange plates for the heat exchange unit, without subjecting such plates to any additional step, thus reducing the manufacturing costs for the heat exchange unit.

In the third aspect of the outer shell structure of the present invention, each of the end walls may comprise an inner plate and a reinforcement member, the inner plate having a larger size than the first opposite planes of the heat exchange unit, the inner plate being welded at edges thereof water-tightly to the corner ridge members, the first walls with an opening and the second walls with an opening, the reinforcement member being formed of a plate having a size, which is identical to or larger than the inner plate, the reinforcement member having a predetermined strength, which prevents the reinforcement member from being deformed by pressure applied by the heat exchange fluid, the reinforcement member being kept in a state in which the reinforcement member is placed on the inner plate so as to come into contact with the inner plate from an outside thereof.

According to the third aspect of the present invention, each of the end walls comprises the inner plate welded to the corner ridge member and the reinforcement member having a sufficient strength, provided outside the inner plate, so as to divide the end wall into a member for maintaining a water-tight condition and another member for imparting resistance to deformation. Combination of these members enables a thin plate with consideration given only to a required minimum strength to be used as the inner plate, thus leading to an easy operation for connecting the thin plate to the corner ridge member or the other wall. On the other hand, reinforcement of the inner plate by the reinforcement member from the outside of the inner plate can ensure a sufficient strength for internal pressure to prevent deformation of the inner plate, thus ensuring a reliable separation not only between the passages for the fluids, but also between these passages and the outside. Any desired material can be used as the reinforcement member, without taking account whether or not it is weldable to the heat exchange unit. A proper selection of material for the reinforcement member may reduce the cost of the whole heat exchanger.

In the fourth aspect of the outer shell structure of the present invention, each of the first walls with an opening may comprise an inner plate and a reinforcement member, the inner plate being provided in a form of a rectangular or square framework having a central opening that is substantially a same as the second opposite planes of the heat exchange unit, the inner plate being welded water-tightly at a peripheral portion of the central opening to the inner plate section of each of the corner ridge members and the end walls, the reinforcement member being formed of a plate having a size, which is identical to or larger than the inner plate, the reinforcement member having a predetermined strength, which prevents the reinforcement member from being deformed by pressure applied by the heat exchange fluid, the reinforcement member being kept in a state in which the reinforcement member is detachably placed on the inner plate so as to come water-tightly into contact with the inner plate from an outside thereof, the reinforcement member having one or more openings at a position corresponding to the central opening of the inner plate; the one or more openings of the reinforcement member and a part of the central opening of the inner plate, which corresponds to the one or more openings form the inlet and outlet for the heat exchange fluids.

According to the fourth aspect of the present invention, the first wall with an opening comprises the inner plate, which has the framework shape and is welded to the corner ridge member, and the reinforcement member having a sufficient strength, provided outside the inner plate, so as to divide the first wall with an opening into a member connected to the heat exchange unit and another member for defining the inlet and outlet for the heat exchange fluids so that the member for defining the inlet and outlet can be removed from the inner plate. Accordingly, it is possible to apply the welding operation for the corner ridge member and the end wall only to the inner plate, with the result that use of a thin plate with consideration given only to a required minimum strength to be used as the inner plate enables the connection operation to the corner ridge member and the end wall to be carried out easily. On the other hand, the structure in which the reinforcement members are secured to the inner plate can ensure a sufficient strength to prevent deformation of the inner plate by the pressure of the fluid, thus ensuring a reliable separation not only between the passages for the fluids, but also between these passages and the outside. In addition, when the reinforcement member is removed from the inner plate, the openings of the first gap portions can be exposed in accordance with a size of the central opening of the inner plate, making it possible to provide the maximum opening through which the exposed state of the heat exchange plates can be provided and thus causing an excellent workability in maintenance of the heat exchange plates, such as a cleaning operation of them. Further, it is possible to place the inlet and outlet for the heat exchange fluids flowing through the first gap portions on predetermined position on the ends of the heat exchanger in accordance with a position of the openings of the reinforcement member, thus improving degree of freedom in design of the heat exchanger and providing excellent effects in general versatility.

In the fifth aspect of the outer shell structure of the present invention, each of the second walls with an opening may comprise an inner plate and a reinforcement member, the inner plate being provided in a form of a rectangular or square framework having a central opening that is substantially a same as the third opposite planes of the heat exchange unit, the inner plate being welded water-tightly at a peripheral portion of the central opening to the outer plate section of each of the corner ridge members and the end walls, the reinforcement member being formed of a plate having a size, which is identical to or larger than the inner plate, the reinforcement member having a predetermined strength, which prevents the reinforcement member from being deformed by pressure applied by the heat exchange fluid, the reinforcement member being kept in a state in which the reinforcement member is detachably placed on the inner plate so as to come water-tightly into contact with the inner plate from an outside thereof, the reinforcement member having one or more openings at a position corresponding to the central opening of the inner plate; the one or more openings of the reinforcement member and a part of the central opening of the inner plate, which corresponds to the one or more openings form the inlet and outlet for the heat exchange fluids.

According to the fifth aspect of the present invention, the second wall with an opening comprises the inner plate, which has the framework shape and is welded to the corner ridge member, and the reinforcement member having a sufficient strength, provided outside the inner plate, so as to divide the second wall with an opening into a member connected to the heat exchange unit and another member for defining the inlet and outlet for the heat exchange fluids so that the member for defining the inlet and outlet can be removed from the inner plate. Accordingly, it is possible to apply the welding operation for the corner ridge member and the end wall only to the inner plate, with the result that use of a thin plate with consideration given only to a required minimum strength to be used as the inner plate enables the connection operation to the corner ridge member and the end wall to be carried out easily. On the other hand, the structure in which the reinforcement members are secured to the inner plate can ensure a sufficient strength to prevent deformation of the inner plate by the pressure of the fluid, thus ensuring a reliable separation not only between the passages for the fluids, but also between these passages and the outside. In addition, when the reinforcement member is removed from the inner plate, the openings of the second gap portions can be exposed in accordance with a size of the central opening of the inner plate, making it possible to provide the maximum opening through which the exposed state of the heat exchange plates can be provided and thus causing an excellent workability in maintenance of the heat exchange plates, such as a cleaning operation of them. Further, it is possible to place the inlet and outlet for the heat exchange fluids flowing through the second gap portions on predetermined position on the ends of the heat exchanger in accordance with a position of the openings of the reinforcement member, thus improving degree of freedom in design of the heat exchanger and providing excellent effects in general versatility.

In the sixth aspect of the outer shell structure of the present invention, each of the second walls with an opening may comprise an inner plate and a reinforcement member, the inner plate being placed in parallel with the third opposite planes of the heat exchange unit, the inner plate being welded water-tightly at opposite parallel sides thereof to edges of the end walls and at at least one of other opposite parallel sides thereof to the corner ridge members placed on both sides of the third opposite planes of the heat exchange unit, the inner plate having one or more openings communicating with the opening of the second gap portion, the reinforcement member being formed of one or more rectangular plates having a predetermined strength, which prevents the plate from being deformed by pressure applied by the heat exchange fluid, so as to provide, alone or in combination with each other, a same size as or a larger size than the inner plate, the reinforcement member being placed water-tightly on the inner plate from an outside thereof in a state in which through-holes through which the one or more openings of the inner plate communicate with the outside in a position corresponding to the openings thereof; the one or more openings of the inner plate form the inlet and outlet for the heat exchange fluids.

According to the sixth aspect of the present invention, the second wall with an opening comprises the inner plate, which is welded to the corner ridge member to cover the second gap portion, and the reinforcement member having a sufficient strength, provided outside the inner plate, so as to divide the second wall with an opening into a member for maintaining a water-tight condition and another member for imparting resistance to deformation. Combination of these members makes it possible to apply the welding operation for the corner ridge member and the end wall only to the inner plate, with the result that use of a thin plate with consideration given only to a required minimum strength to be used as the inner plate enables the connection operation to the corner ridge member and the end wall to be carried out easily. On the other hand, the structure in which the reinforcement members are secured to the inner plate can ensure a sufficient strength to prevent deformation of the inner plate by the pressure of the fluid, thus ensuring a reliable separation not only between the passages for the fluids, but also between these passages and the outside. In addition, any desired material can be used as the reinforcement member, without taking account whether or not it is weldable to the heat exchange unit. A proper selection of material for the reinforcement member may reduce the cost of the whole heat exchanger. Further, it is possible to place the inlet and outlet for the heat exchange fluids flowing through the second gap portions on predetermined position on the ends of the heat exchanger in accordance with a position of the openings of the end wall, thus improving degree of freedom in design of the heat exchanger and providing excellent effects in general versatility.

In the seventh aspect of the outer shell structure of the present invention, each of the second walls with an opening may comprise one or more inner plates and a reinforcement member, the inner plate being placed in parallel with the third opposite planes of the heat exchange unit, the inner plate being welded water-tightly at opposite parallel sides thereof to at least edges of the end walls and the reinforcement member being formed of a rectangular plate having a same size as or a larger size than the inner plate and a predetermined strength, which prevents the plate from being deformed by pressure applied by the heat exchange fluid, the reinforcement member being placed water-tightly on the inner plate from an outside thereof the inner plate causing at least one of other opposite parallel sides thereof perpendicular to the opposite parallel sides thereof to be placed along the third opposite planes of the heat exchange unit so as to form openings between at least one of the other opposite parallel sides and the corner ridge members placed on the third opposite planes of the heat exchange or edges of the inner plate; the reinforcement member keeping the openings in a released state in which the openings communicate with the outside; the openings form the inlet and outlet for the heat exchange fluids.

According to the seventh aspect of the present invention, the second wall with an opening comprises the inner plate, which is welded to the corner ridge member to cover the second gap portion, and the reinforcement member having a sufficient strength, provided outside the inner plate, so as to divide the second wall with an opening into a member for maintaining a water-tight condition and another member for imparting resistance to deformation. Combination of these members makes it possible to apply the welding operation for the corner ridge member and the end wall only to the inner plate, with the result that use of a thin plate with consideration given only to a required minimum strength to be used as the inner plate enables the connection operation to the corner ridge member and the end wall to be carried out easily. On the other hand, the structure in which the reinforcement members are secured to the inner plate can ensure a sufficient strength to prevent deformation of the inner plate by the pressure of the fluid, thus ensuring a reliable separation not only between the passages for the fluids, but also between these passages and the outside. In addition, any desired material can be used as the reinforcement member, without taking account whether or not it is weldable to the heat exchange unit. A proper selection of material for the reinforcement member may reduce the cost of the whole heat exchanger. Further, it is possible to determine a size of the inlet and outlet for the heat exchange fluids flowing through the second gap portions on predetermined position on the ends of the heat exchanger in accordance with a position of the opening of the second wall in the vicinity of the corner ridge member, thus improving degree of freedom in design of the heat exchanger and providing excellent effects in general versatility.

In the eighth aspect of the outer shell structure of the present invention, the inner plate may cause one of the other opposite parallel sides thereof to be placed along the third opposite planes of the heat exchange unit so as to form other openings between the one of the other opposite parallel sides and a closer one of the corner ridge members placed on the third opposite planes of the heat exchange unit; the reinforcement member keeping the other openings in a released state in which the other openings communicate with the outside.

According to the eighth aspect of the present invention, the predetermined edge of the inner plate for forming the second wall with an opening provides a released area serving as the other openings. It is therefore possible to determine a size of the inlet and outlet for the heat exchange fluids flowing through the second gap portions on predetermined position on the ends of the heat exchanger in accordance with placement of the other edge of the inner plate in the vicinity of the corner ridge member, thus improving degree of freedom in design of the heat exchanger and providing a simple structure for the member for defining the openings and its periphery.

In the ninth aspect of the outer shell structure of the present invention, the inlet of said inlet and outlet for said second heat exchange fluid, which communicate with the second gap portions, may be placed on a side of one of said first walls with an opening on at least one of said second walls with an opening, and the outlet thereof may be placed on a side of another of said first walls with an opening on at least one of said second walls with an opening.

According to the ninth aspect of the present invention, the inlet and outlet for the other heat exchange fluid, which are provided on the opposite sides of the heat exchanger, respectively, are placed in the vicinity of the first walls with an opening of the heat exchanger, that are spaced apart from each other so that the other heat exchange fluid flows from one end of the second gap portion of the heat exchange unit to the other end thereof. It is therefore possible to provide a parallel flow relative to the heat exchange fluid flowing in the first gap portion, while supplying and discharging the other heat exchange fluid at the sides of the heat exchanger, so that the heat exchange fluids flow on the opposite surfaces of the plate in a flowing relationship based on a parallel flowing system or a counter-flowing system. The heat exchanger that has an excellent heat exchange efficiency, although has a small size, can be provided in this manner.

DETAILED DESCRIPTION OF THE PREFERRED EMBODIMENTS

First Embodiment of the Present Invention

Figure 1:
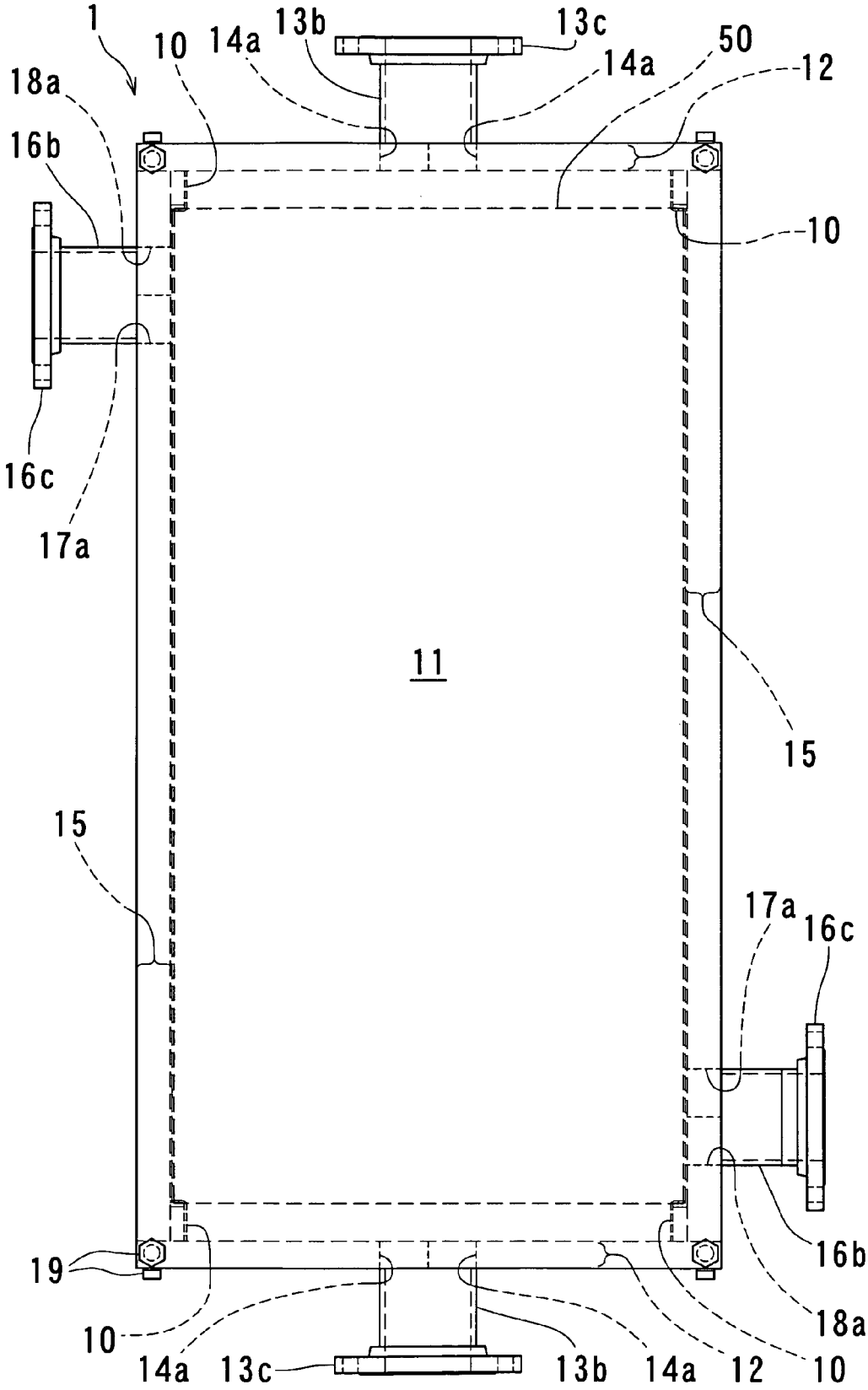
FIG. 1 is a front view of a heat exchanger according to the first embodiment of the present invention.
Figure 2:
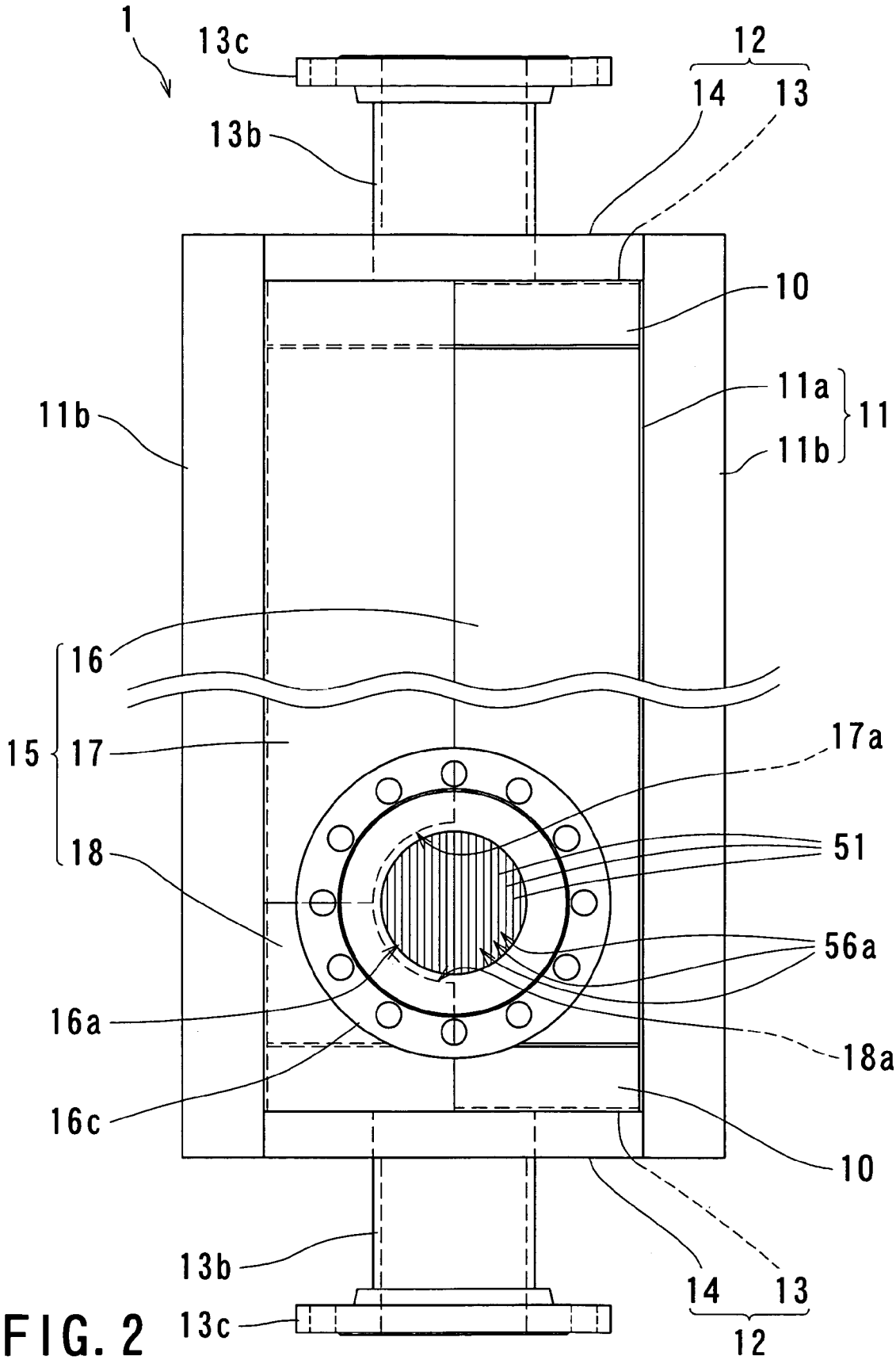
FIG. 2 is a partially enlarged left-hand side view of the heat exchanger according to the first embodiment of the present invention.
Figure 3:
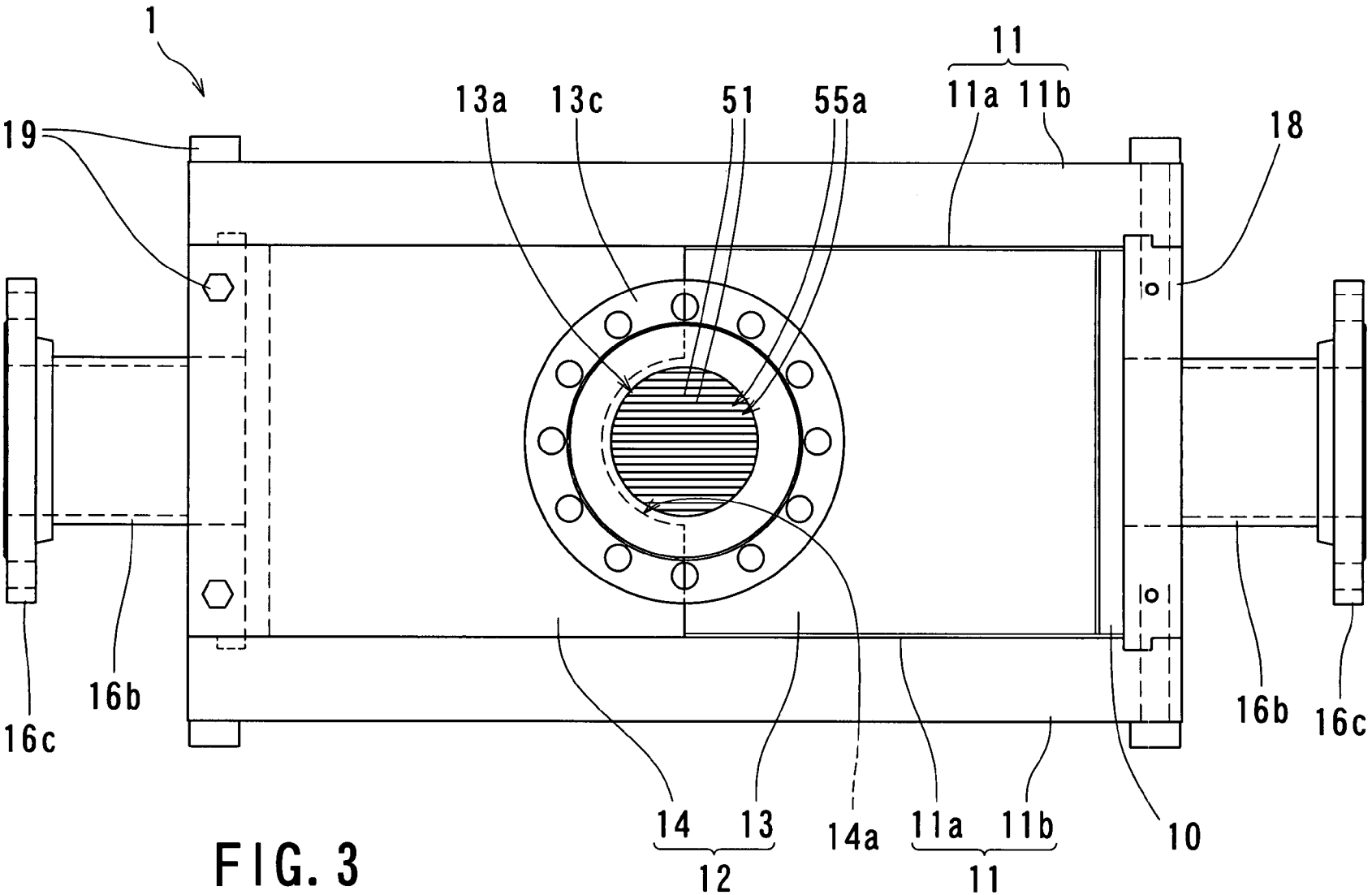
FIG. 3 is a partially enlarged bottom view of the heat exchanger according to the first embodiment of the present invention.
Figure 4:
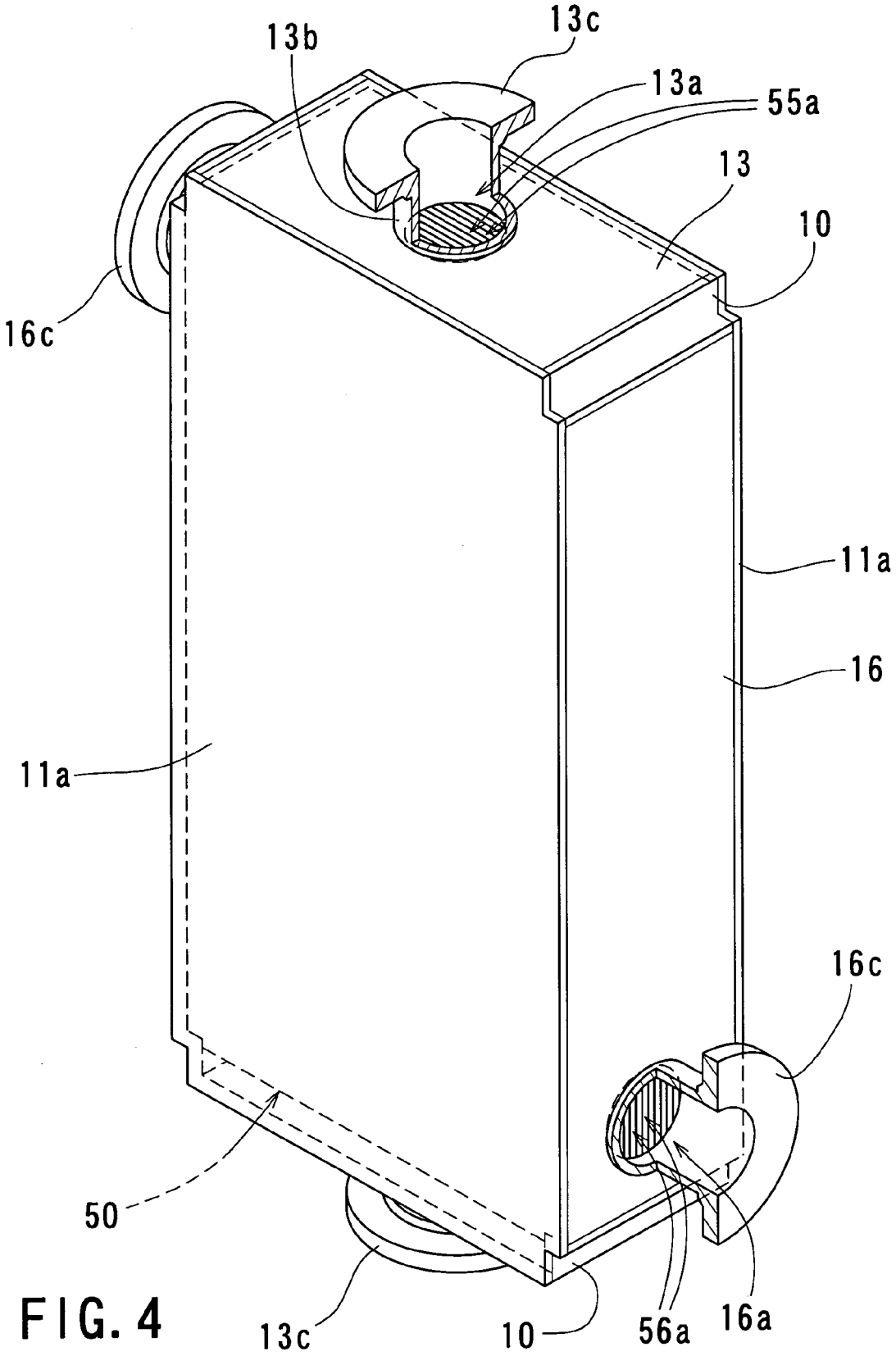
FIG. 4 is a descriptive view illustrating a state in which a corner ridge member and an inner plate are connected to a heat exchange unit of the heat exchanger according to the first embodiment of the present invention.
Figure 5:
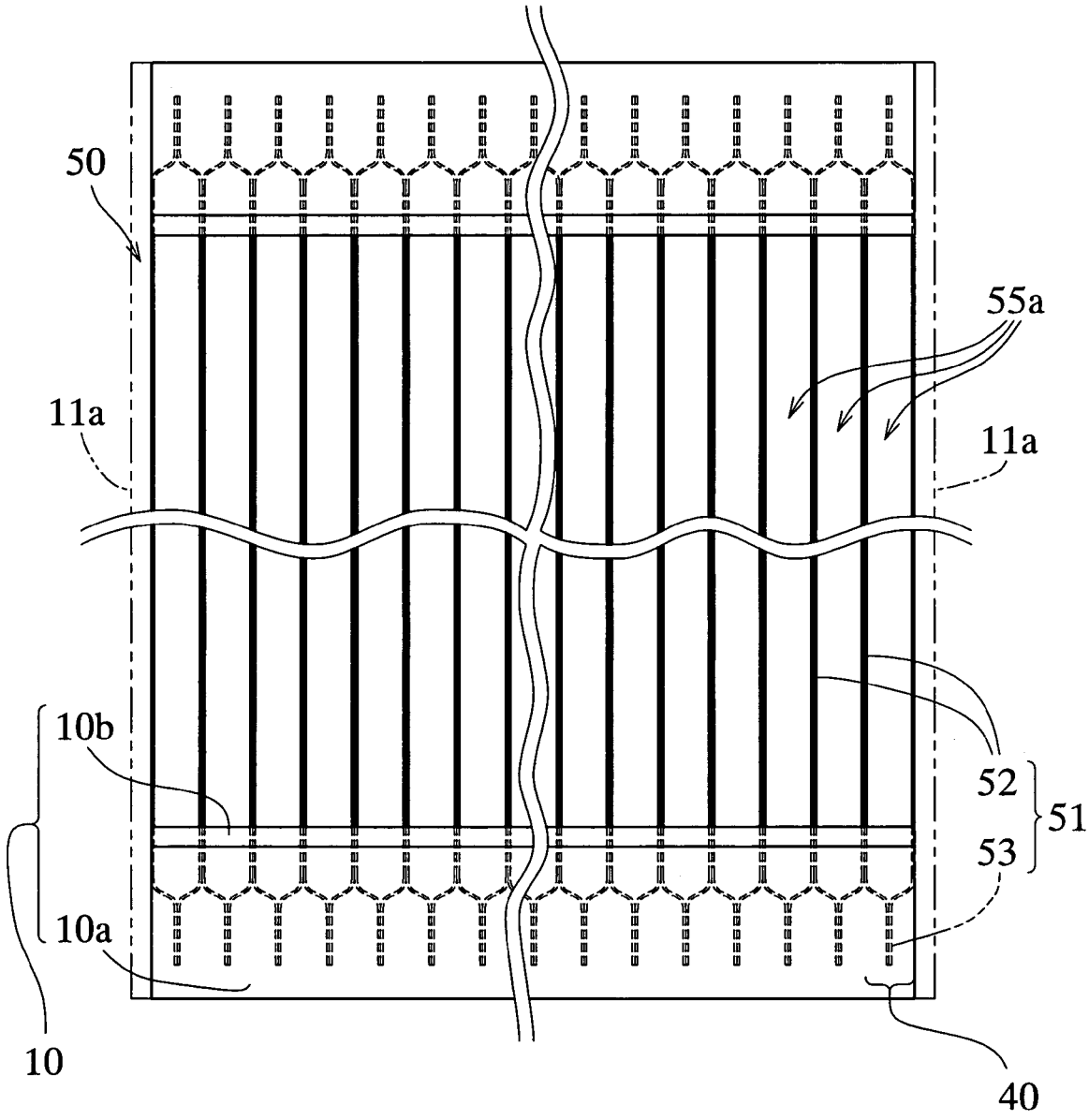
FIG. 5 is a descriptive view illustrating a state in which the corner ridge member is combined to the heat exchange unit of the heat exchanger according to the first embodiment of the present invention.
Figure 6:
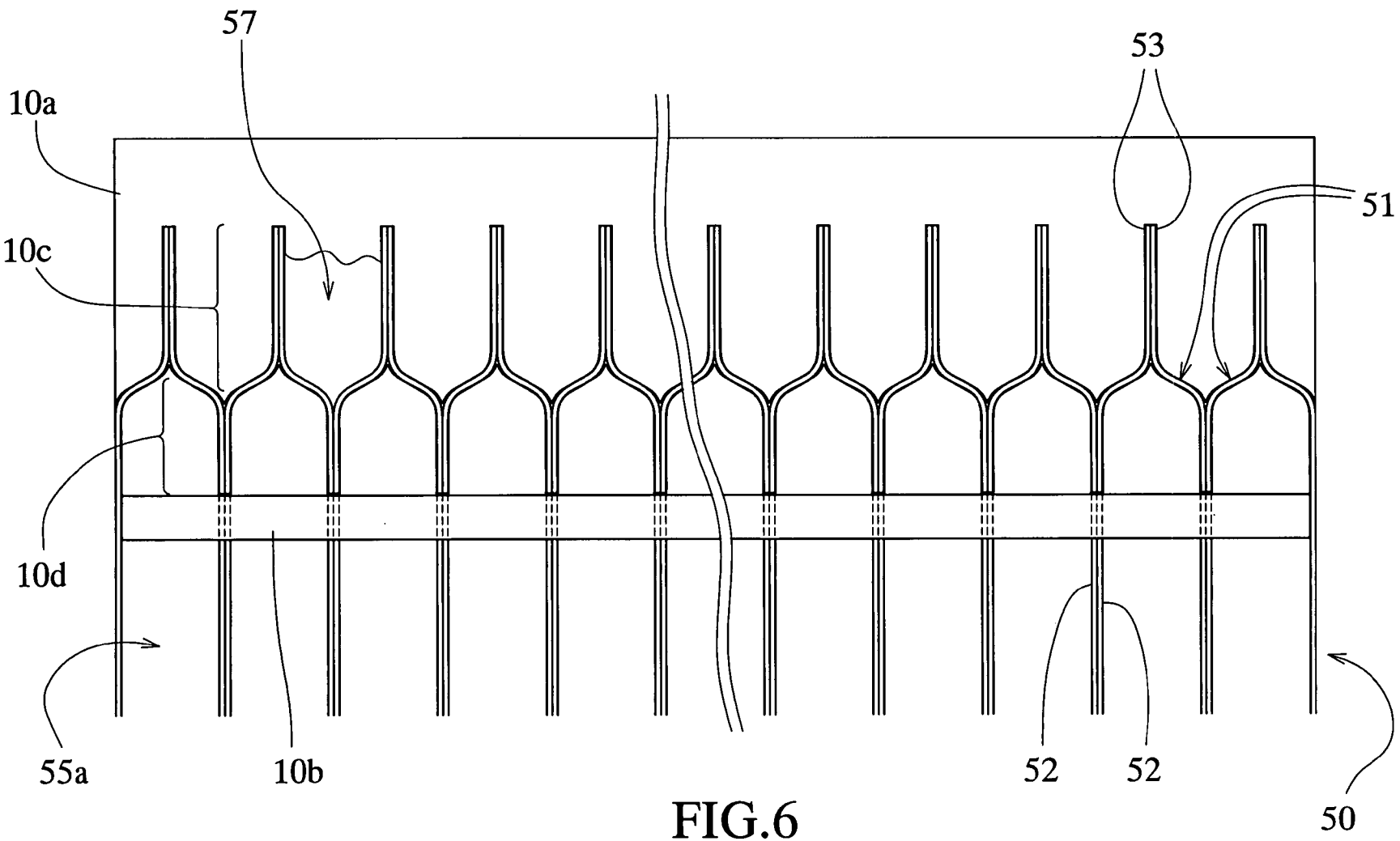
FIG. 6 is a descriptive view illustrating a state in which an outer plate section and an inner plate section are placed on an edge of the heat exchange unit of the heat exchanger according to the first embodiment of the present invention.
Figure 7A:
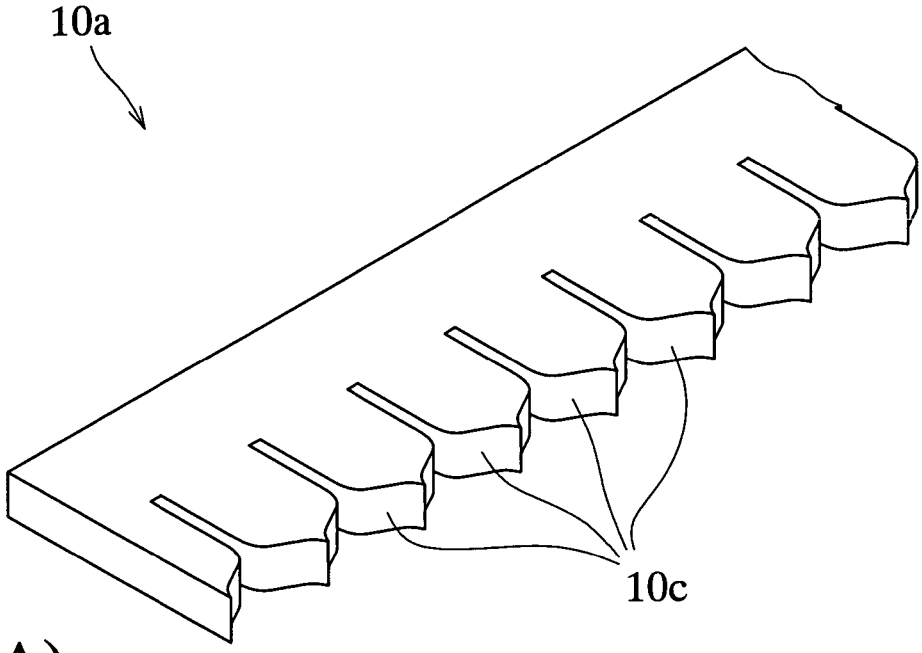
FIG. 7(A) is a partial perspective view of the outer plate section used in the heat exchanger according to the first embodiment of the present invention and FIG. 7(B) is a partial perspective view of the inner plate section used therein.
Figure 7B:
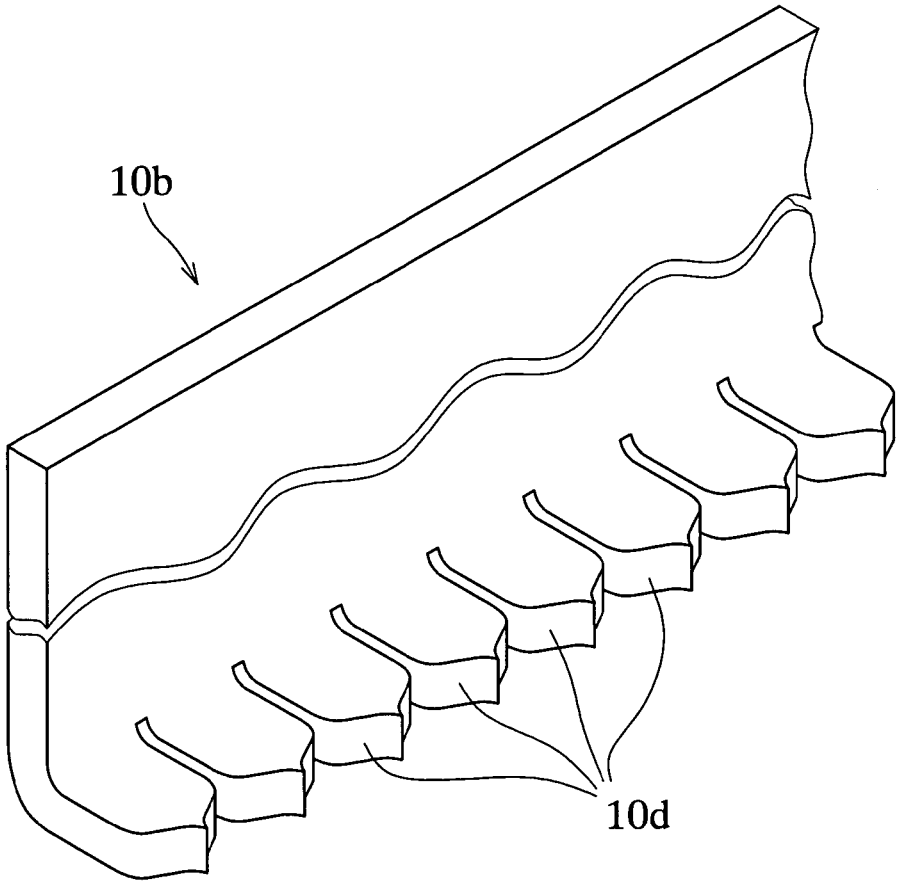
Figure 8:
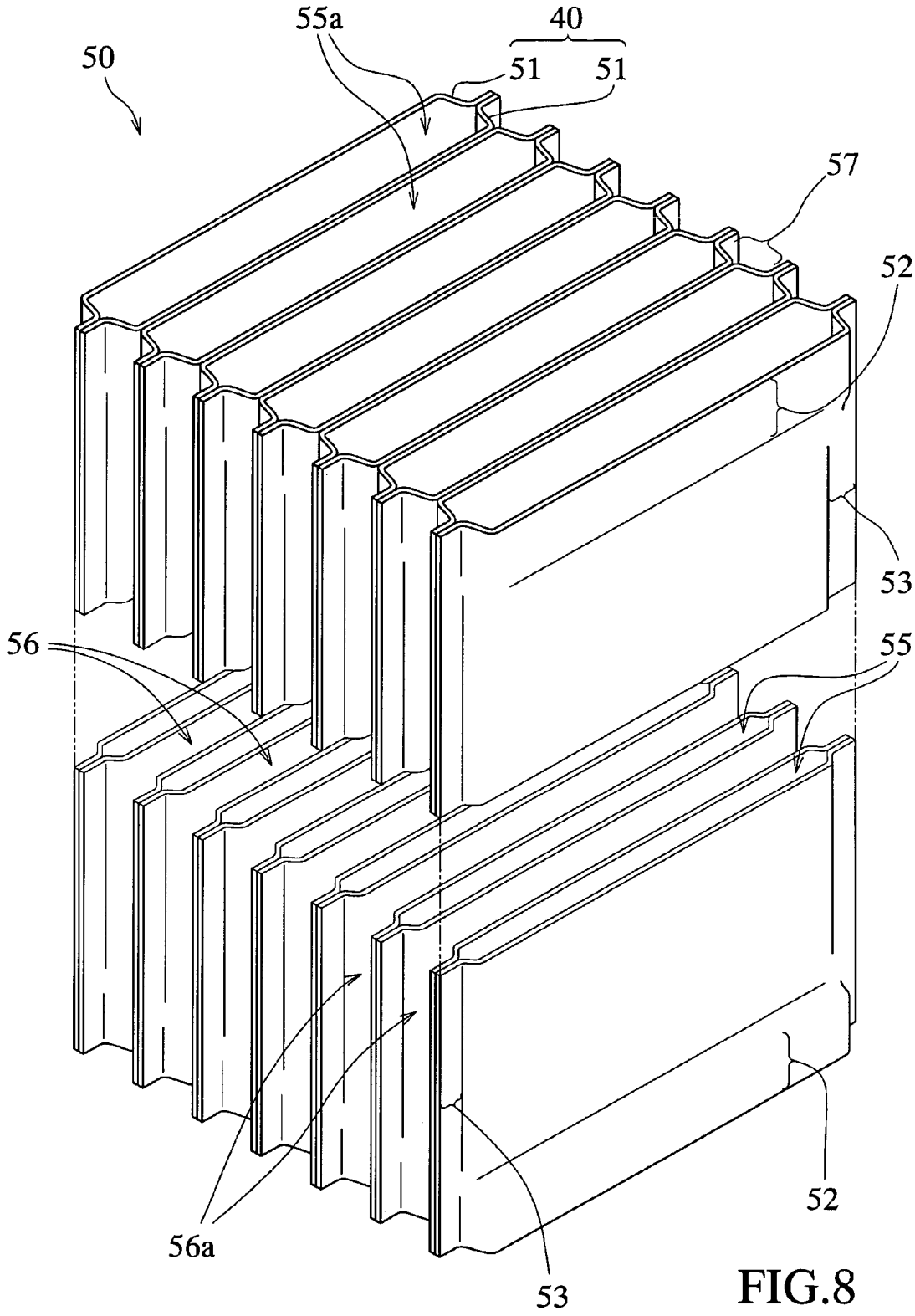
FIG. 8 is a schematic perspective view of the heat exchange unit of the heat exchanger according to the first embodiment of the present invention.
Figure 9:
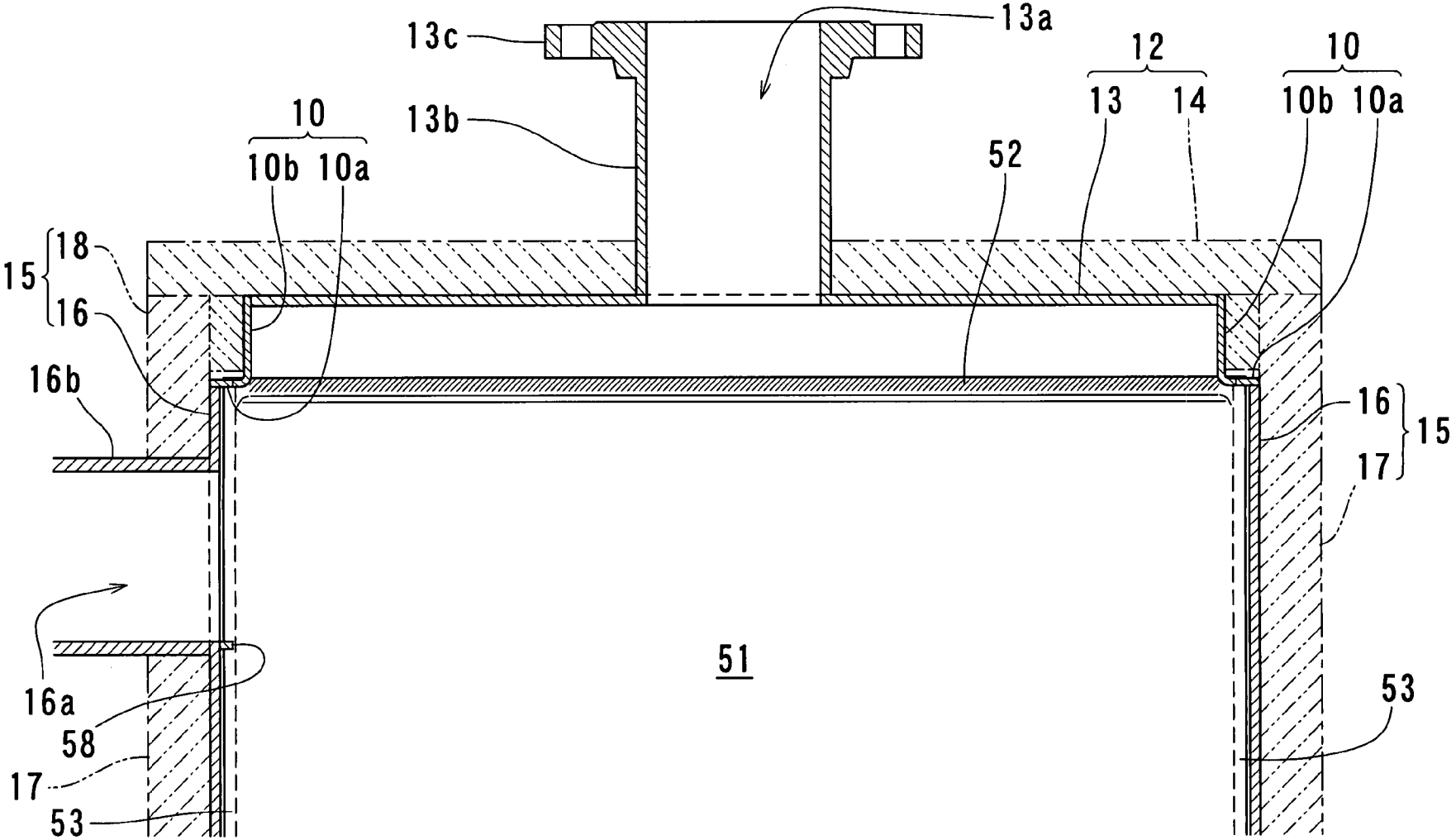
FIG. 9 is a vertical cross-sectional view of an upper side of the heat exchanger according to the first embodiment of the present invention.
Figure 10:
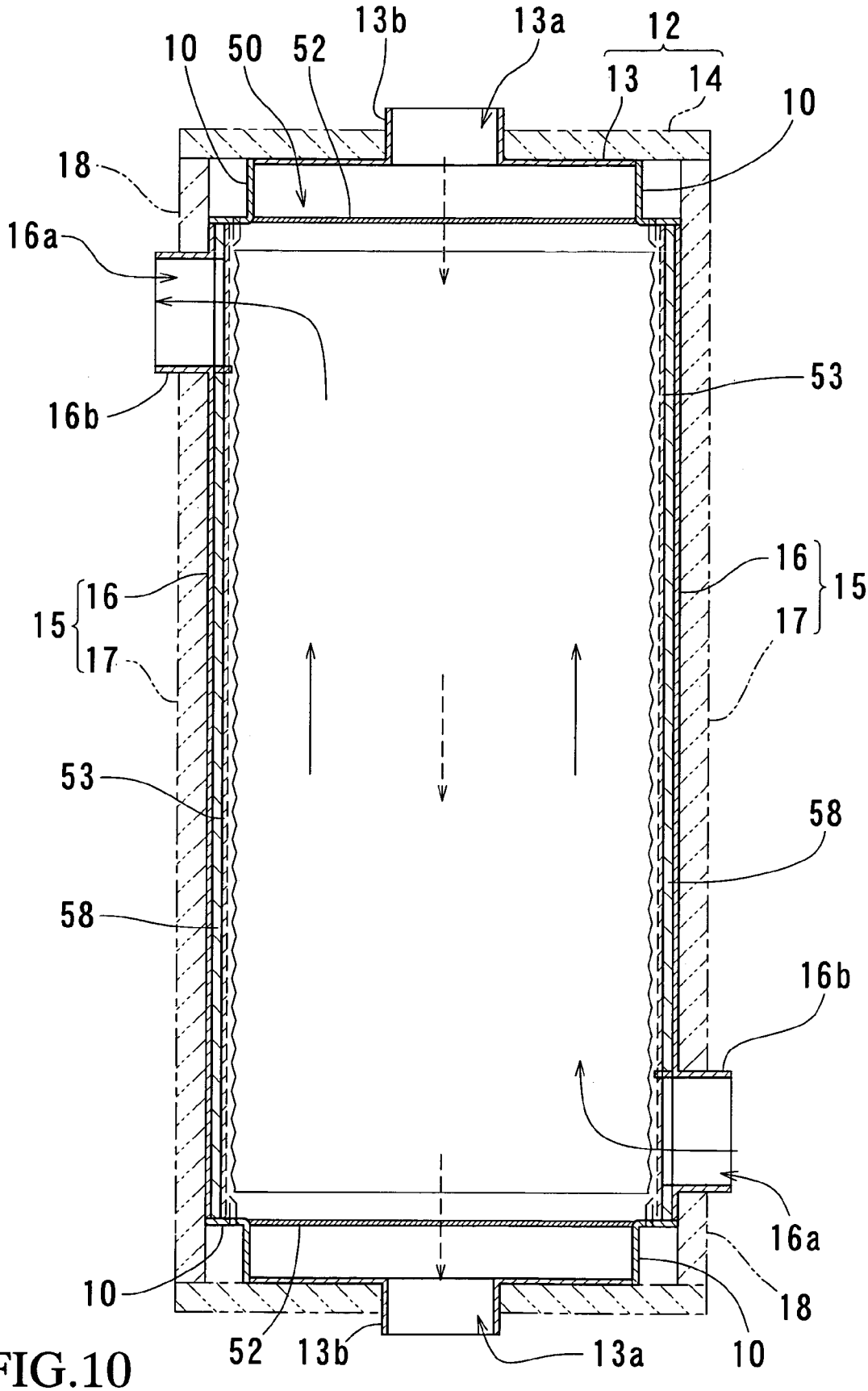
FIG. 10 is a schematic descriptive view of flow of a liquid in the second gap portion of the heat exchanger according to the first embodiment of the present invention.
Figure 11:
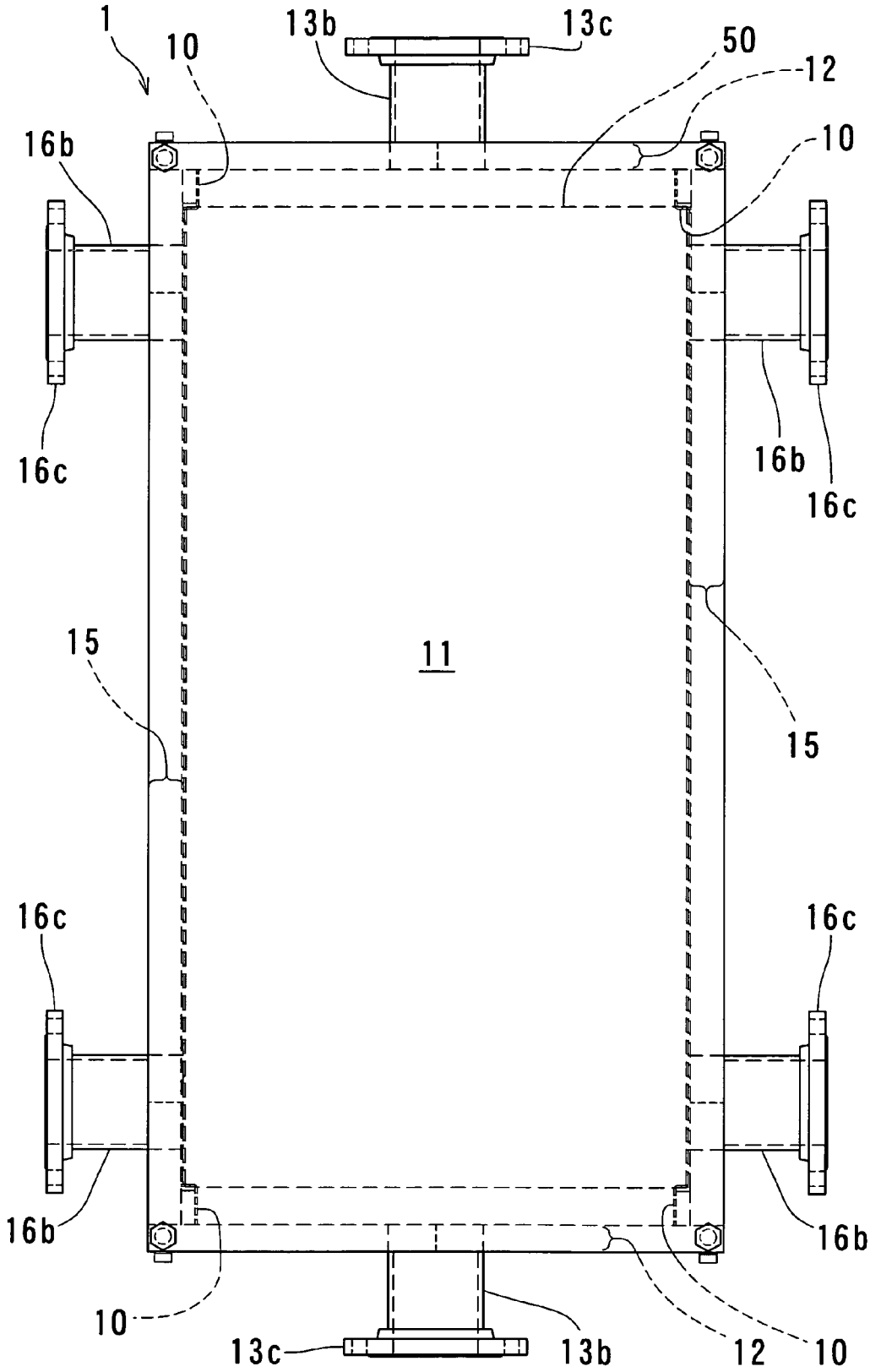
FIG. 11 is a front view of another heat exchanger according to the first embodiment of the present invention.

Now, the first embodiment of the present invention will be described in detail below with reference to FIGS. 1 to 10. FIG. 1 is a front view of a heat exchanger according to the first embodiment of the present invention; FIG. 2 is a partially enlarged left-hand side view of the heat exchanger according to the first embodiment of the present invention; FIG. 3 is a partially enlarged bottom view of the heat exchanger according to the first embodiment of the present invention; FIG. 4 is a descriptive view illustrating a state in which a corner ridge member and an inner plate are connected to a heat exchange unit of the heat exchanger according to the first embodiment of the present invention; FIG. 5 is a descriptive view illustrating a state in which the corner ridge member is combined to the heat exchange unit of the heat exchanger according to the first embodiment of the present invention; FIG. 6 is a descriptive view illustrating a state in which an outer plate section and an inner plate section are placed on an edge of the heat exchange unit of the heat exchanger according to the first embodiment of the present invention; FIG. 7(A) is a partial perspective view of the outer plate section used in the heat exchanger according to the first embodiment of the present invention and FIG. 7(B) is a partial perspective view of the inner plate section used therein; FIG. 8 is a schematic perspective view of the heat exchange unit of the heat exchanger according to the first embodiment of the present invention; FIG. 9 is a vertical cross-sectional view of an upper side of the heat exchanger according to the first embodiment of the present invention; and FIG. 10 is a schematic descriptive view of flow of a liquid in the second gap portion of the heat exchanger according to the first embodiment of the present invention.

As shown in these figures, an outer shell structure for a heat exchanger 1 according to the first embodiment of the present invention includes four corner ridge members 10, a pair of end walls 11, a pair of opposite first walls 12 with an opening and a pair of opposite second walls 15 with an opening. The corner ridge members 10, the end walls 11, the first walls 12 with an opening and the second walls 15 with an opening are placed around a heat exchange unit into which a plurality of heat exchange plates formed of a metallic plate are placed in parallel with each other and welded together.

Prior to detailed description of the outer shell structure, description will be given below of the fundamental structure of the heat exchange unit 50. The heat exchange unit 50 is composed of a plurality of heat exchange plates 51. The heat exchange plate 51, which is formed of a metallic thin plate having a rectangular shape, is subjected to a press forming step to form a pattern of irregularity serving as a heat transfer section in the central portion of the plate, terraced flat portions 52 along the pair of opposite edges of the plate and non-terraced flat portions 53 along the other pair of opposite edges thereof. The heat transfer section has the optimized pattern of irregularity that is designed to make heat exchange between a heat exchange fluid flowing along the upper surface of the plate and the other heat exchange fluid flowing along the lower surface thereof. Such a pattern of irregularity, which includes a wave-shape cross section by which an excellent heat transfer property is provided, and groove portions through which condensed water can be discharged rapidly. The pattern of irregularity is known and description thereof will be omitted.

The heat exchange plate 51 is placed on the other heat exchange plate 51 so that the inner surface, i.e., the surface located on the opposite side of the terraced portion 52 of the former faces the corresponding inner surface of the latter and these plates are welded together on the opposite longer sides, i.e., the terraced portion 52 thereof over their entirety, to prepare a combined sub-unit. Such a combined sub-unit is placed on the other combined sub-unit so that the outer surface, i.e., the surface located on the side of the terraced portion 52 of one of the plates of the former combined sub-unit faces the corresponding outer surface of one of the plates of the latter combined sub-unit, and these combined sub-units are welded together on the other opposite shorter sides, i.e., the non-terraced portions 53 thereof over their entirety, excepting the non-terraced portions 53 on the opposite ends included in zones to be welded on the inner surfaces of the plate, to prepare a combined unit. Such a welding step is repeated to manufacture the heat exchange unit 50 in which the heat exchange plates 51 are placed in parallel with each other. In the actual manufacture of the heat exchange unit 50, the above-described step for welding the non-terraced portions 53 along the longer sides of the plates is carried out for a plural pairs of the heat exchange plates to prepare a plurality of sub-units and then the thus prepared sub-units are subjected to the above-described step for welding the terraced portions 52 along the shorter sides of the plates.

In such a heat exchange unit 50, there are formed between the opposing inner surfaces of the plates the first gap portions 55 through which the first heat exchange fluid flows and there are formed between the opposing outer surfaces of the plates the second gap portions 56 through which the second heat exchange fluid flows, so that the first and second gap portions are provided alternately. The first gap portions 55 are gaps formed along the plural pairs of parallel shorter sides of the heat exchange plates 51 and the first heat exchange fluid flows through openings 55*a* defined by the opposing terraced portions 52 of the plates. On the other hand, the second gap portions 56 are gaps formed along the plural pairs of parallel longer sides of the heat exchange plates 51 and the second heat exchange fluid flows through openings 56*a* defined by the opposing non-terraced portions 53 of the plates.

The above-mentioned heat exchange unit 50 has six planes, i.e., a pair of first opposite planes that are in parallel with the heat exchange plates 51, a pair of second opposite planes that are placed on the opening sides of the above-mentioned first gap portions 55 and a pair of third opposite planes that are placed on the opening sides of the above-mentioned second gap portions 56.

The corner ridge members 10 include an outer plate section 10*a* and an inner plate section 10*b* that are formed of a thick metallic plate and have serration portions. The serration portions of the outer and inner plate section 10*a*, 10*b* are inserted into the gaps between the plural pairs of heat exchange plates 51 and then welded to them. The end walls 11 are placed on the pair of first opposite planes of the heat exchange unit 50, respectively, so as to cover the pair of first opposite planes thereof from the outside. The end walls 11 are connected to the above-mentioned corner ridge members 10 in such a state. The first walls 12 with an opening are placed on the pair of second opposite planes of the heat exchange unit 50, respectively, so as to cover the pair of second opposite planes thereof from the outside. The first walls 12 with an opening are connected to the corner ridge members 10 and the end walls 11. The second walls 15 with an opening are placed on the pair of third opposite planes of the heat exchange unit 50, respectively, so as to cover the pair of third opposite planes thereof from the outside. The second walls 15 with an opening are also connected to the corner ridge members 10 and the end walls 11.

The corner ridge members 10 are welded to the opposite end walls and the heat exchange plates. Each of the corner ridge members 10 includes an outer plate section 10*a* and an inner plate section 10*b*. Each of the outer and inner plate sections 10*a*, 10*b* is provided at the longitudinal side thereof with a serration portion 10*c*, 10*d* having serrations that are formed at same intervals as the heat exchange plates aligned with the same orientation of the heat exchange plates. The serration portion 10*c* of the outer plate section 10*a* is inserted into the gaps 57 between the heat exchange plates that are welded together at the first pair of side edges thereof over the entire length thereof, of the heat exchange unit. The serration portion 10*d* of the inner plate section 53 is inserted into the openings 55*a* of the first gap portions 55 by a predetermined length.

The outer plate section 10*a*, which is formed of the same metallic material as the heat exchange plate 51, but has a larger thickness than the heat exchange plate 51, is provided at its longitudinal edge with the serration portion 10*c*. The serration portion 10*c* has a shape that conforms to the gaps 57 each of which is formed between the welded non-terraced flat portions of a pair of the heat exchange plates 51 and the welded non-terraced flat portions of the adjacent pair of the heat exchange plates 51. These gaps 57 are placed in the vicinity of the above-mentioned openings 55*a*. The other longitudinal edge of the serration portion 10*c* of the outer plate section 10*a*, which edge is placed on the opposite side to the serration portion 10*c*, projects from the edges of the heat exchange plates 51 by a small distance in a state in which the serration portion 10*c* is inserted into the gaps 57 as mentioned above.

The inner plate section 10*b*, which is formed of the same metallic plate as the outer plate section 10*a*, is provided at a longitudinal side with a bent portion that is bent at right angles to a body of the inner plate section 10*b*. The bent portion has at the longitudinal edge the serration portion 10*d*. The serration portion 10*d* has a shape that conforms to the gaps 55*a* at the opposite sides of the openings 55*a*, as shown in FIG. 5. The other longitudinal side of the inner plate 10*b*, which is placed at right angles to the serration portion 10*d*, projects from the edges of the heat exchange plates 51 by a predetermined distance in a state in which the serration portion 10*d* is inserted into the gaps 55*a* as mentioned above.

The end walls 11 are placed on the pair of first opposite planes of the heat exchange unit 50, which are in parallel with the heat exchange plates 51, so as to cover the pair of opposite planes, respectively. The end walls are connected water-tightly to the edges of each corner ridge member 10, which are located on the opposite sides in the aligning direction of the heat exchange plates 51. Each of the end walls is composed of a combination structure of two plates, i.e., an inner plate 11*a* and a reinforcement member 11*b*.

The inner plate 11*a* is formed of the same thin metallic material as the heat exchange plate 51. The inner plate 11*a* has a long side length, which is identical to the total of the long side length of the heat exchange unit 50 and the double of the length of the portion of the corner ridge member 10, which projects from the heat exchange unit 50 in the direction of the long side thereof, and a short side length, which is identical to the total length of the short side length of the heat exchange unit 50, the length of the portion of the left-hand corner ridge member 10, which projects from the heat exchange unit 50 in the direction of the short side thereof, and the length of the portion of the right-hand corner ridge member 10, which projects from the heat exchange unit 50 in the direction of the short side thereof. In addition, the inner plate 11*a* has cutouts at its corners. Each inner plate 11*a* is welded water-tightly to the corner ridge member 10, the first wall 12 with an opening and the second wall 15 with an opening so as to be combined integrally with the heat exchange unit 50.

The reinforcement member 11*b* is formed of a plate that has a larger thickness than the inner plate 11*a* and a predetermined strength, which prevents the reinforcement member 11*b* from being deformed by pressure applied by the heat exchange fluid introduced into the heat exchange unit 50. The reinforcement member 11*b* has a larger size both in the long and short sides thereof than the inner plate 11*a* by a predetermined length. The reinforcement member 11*b* is placed on the inner plate 11*a* from the outside thereof so as to come into contact therewith and connected at its ends to the first wall 12 with an opening and the second wall 15 with an opening by means of bolts 19. The reinforcement member 11*b* is combined together with the inner plate 11*a* and the heat exchange unit 50 in this manner. The different material from the inner plate 11*a* and the heat exchange unit 50 may be used as material for forming the reinforcement member 11*b*, as long as the above-mentioned different material has an appropriate strength and characteristic property that does not vary due to contact with the heat exchange fluid.

The first walls 12 with an opening are placed respectively on the outside of the pair of second opposite planes of the heat exchange unit 50, which are located on the sides of the openings 55*a* sides of the above-mentioned first gap portions 55. The first wall 12 with an opening is connected water-tightly to portions of the inner plate section 10*b* of the corner ridge member 10, which are placed on the opposite sides of the openings 55*a* of the first gap portions 55, and to the edges of the end wall 11. The first wall 12 with an opening isolates the openings 55*a* of the first gap portions 55 from the outside, except for the inlet and outlet for the heat exchange fluid. The first wall 12 with an opening also has a combined structure of two plates, i.e., an inner plate 13 and a reinforcement member 14.

The inner plate 13 is formed of the same thin metallic plate as the inner plate 11*a* of the above-mentioned end wall 11. The inner plate 13 has substantially the same rectangular shape as the second opposite planes of the heat exchange unit 50, that are placed on the side of the openings 55*a*, and is provided in the central position thereof with a hole 13*a* formed thereon. The edges of the inner plate 13 are welded water-tightly to the other portions of the inner plate section 10*b* of the corner ridge member 10 and the inner plate 11*a* of the end wall 11. The inner plate 13 is welded to the heat exchange unit 50 to cover the plane thereof from the outside, except for the opening 55*a* and the hole 13*a*.

The hole 13*a* of the inner plate 13 serves as the inlet and outlet for the heat exchange fluid, that communicate with the first gap portion 55 through the openings 55*a*. A pipe 13*b* for introducing the fluid is connected to the hole 13*a*. The pipe 13*b* is provided at its end integrally with a flange 13*c* to which a supply/discharge pipe for the heat exchange fluid is to be connected.

The above-mentioned reinforcement member 14 is composed of two plates, each of which has a lateral length, which is just one-half of that of the reinforcement member 11*b* of the above-mentioned end wall 11 and a depth length, which enables the reinforcement member 14 to be placed between the two reinforcement members 11*b* of the end wall 11, and has the similar strength to the reinforcement member 11*b* of the end wall 11. The above-mentioned plates are placed on the inner plate 13 from the outside so as to receive the pipe 13*b* outwardly connected to the hole 13*a* of the inner plate 13. The reinforcement member 14 into which the plates are combined has a cutoff 14*a* in the central position thereof, for receiving the pipe 13*b* projecting from the inner plate 13. The reinforcement member 14 firmly covers the inner plate 13 in a state in which only the pipe 13*b* and the flange 13*c* are exposed outside. The reinforcement member 14 is firmly fixed through bolts 19 to the upper and lower edges of the reinforcement member 11*b* of the end wall 11, which project from the inner plate 11*a* just by the distance corresponding to the thickness of the reinforcement member 13.

The second walls 15 with an opening are placed respectively on the outside of the pair of third opposite planes of the heat exchange unit 50, which are located on the sides of the openings 56*a* sides of the above-mentioned second gap portions 56. The second wall 15 with an opening is connected water-tightly to portions of the outer plate section 10*a* of the corner ridge member 10, which are placed on the opposite sides of the openings 56*a* of the second gap portions 56, and to the edges of the end wall 11. The second wall 15 with an opening isolates the openings 56*a* of the second gap portions 56 from the outside, except for the inlet and outlet for the other heat exchange fluid. The second wall 15 with an opening has a combined structure of three plates, i.e., an inner plate 16 and reinforcement members 17 and 18.

The inner plate 16 is formed of the same thin metallic plate as the inner plate 11*a* of the above-mentioned end wall 11. The inner plate 16 has substantially the same rectangular shape as the third opposite planes of the heat exchange unit 50, that are placed on the side of the openings 56*a*, and is provided in the vicinity of the edge thereof with a hole 16*a* formed thereon. The edges of the inner plate 16 are welded water-tightly to the other portions of the outer plate section 10*a* of the corner ridge member 10 and the inner plate 11*a* of the end wall 11. The inner plate 16 is welded to the heat exchange unit 50 to cover the plane thereof from the outside, except for the opening 56*a* and the hole 16*a*. The hole 16*a* of the inner plate 16 is placed in the vicinity of the lower first wall 12 and the hole 16*a* of the other inner plate 16 is placed in the vicinity of the upper first wall 12.

The hole 16*a* of the inner plate 16 serves as the inlet and outlet for the heat exchange fluid, that communicate with the second gap portion 56 through the openings 56*a*. A pipe 16*b* for introducing the fluid is connected to the hole 16*a* in the same manner as the above-described first wall 12. The pipe 16*b* is provided at its end integrally with a flange 16*c* to which a supply/discharge pipe for the heat exchange fluid is to be connected. In addition, a gap closure member 58 is provided to close a gap formed between the inner plate 16 and the heat exchange unit 50 in the longitudinal direction thereof. The gap closure member 58 has a portion (not shown) having a cross-section of serrations that substantially conform to a shape of the gap 57 formed between the non-terraced flat portions 53 at the edge of the heat exchange unit 50.

The above-mentioned reinforcement members 17, 18 are formed of large and small plates. The plates as combined together have a longitudinal length, which is identical to the total of the longitudinal length of the heat exchange unit 50 and the double of the projection length by which the corner ridge member 10 projects and a depth length, which is identical to that of the reinforcement member 14 of the first wall 12 and have the similar strength to the reinforcement member 11*b* of the end wall 11. The above-mentioned plates are placed on the inner plate 16 from the outside so as to receive the pipe 16*b* outwardly connected to the hole 16*a* of the inner plate 16. Each of the reinforcement member 17, 18 into which the plates are combined has a cutoff 17*a*, 18*a* in the central position thereof, for receiving the pipe 16*b* projecting from the inner plate 16. The reinforcement member 17 or 18 firmly covers the inner plate 16 in a state in which only the pipe 16*b* and the flange 16*c* are exposed outside. The reinforcement member 17, 18 is firmly fixed through bolts 19 to the side edges of the reinforcement member 11*b* of the end wall 11, which project from the inner plate 11*a* just by the distance corresponding to the thickness of the reinforcement member 17, 18. With respect to combination of the reinforcement members 17, 18, the larger reinforcement member 17 is placed on the upper side on the plane of the heat exchange unit, and the smaller reinforcement member 18 is placed on the upper side on the other plane thereof, in accordance with the position of the hole 16*a* of the inner plate 16.

Now, description will be given below of steps for manufacturing the outer shell structure for a heat exchanger according to the embodiment of the present invention. A heat exchange plate obtained by subjecting a blank plate to a press-formation step is placed on the other heat exchange plate obtained in the same manner so that the latter plate is turned upside down and the inner surface of the former plate face the inner surface of the latter plate. In such a state, the non-terraced flat portions 53 of the former plate, which are placed along the opposite longitudinal sides thereof, come into contact with the non-terraced flat portions 53 of the latter plate.

These two heat exchange plates 51 are seam-welded at the flat portions 53 serving as an area to be welded to prepare a single set of plates 40 as combined. The first gap portion 55 is provided between the heat exchange plates 51 of the set of plates 40 so that the opening 55*a* of the first gap portion 55 opens so as to be defined by the terraced portions 52 that are formed along the short sides of the plates (see FIG. 8). The set of plates 40 is placed on the other set of plates 40, which has been prepared in the same manner, so that the terraced portion 52 of the former set comes into contact with the terraced portion 52 of the latter set. In such a state, these sets of plates 40 are seam-welded together at the terraced portions 52 thereof.

In such a state in which the sets of plates 40 are welded together, the second gap portion 56 is provided between the sets of plates 40 so that the opening 56*a* of the second gap portion 56 opens between the non-terraced flat portions 53 (see FIG. 8). The same steps as described above are repeatedly carried out to prepare a plural sets of plates 40 and all the sets of plates 40 are subjected to the seam-welding to combine these sets together, thus preparing the heat exchange unit 50. The gap between the terraced flat portions 52 is too narrow for an electrode of a seam-welding machine to reach physically the opposite ends of the terraced flat portion 52 for contact thereto. Accordingly, unweldable regions remain on the opposite sides of the seam-welded portions in the vicinity of the openings 55*a* over the predetermined length, thus not yet providing a state in which the heat exchange plates are completely joined without any gap between them.

Then, the serration portion 10*c* of the outer plate section 10*a* is inserted into the gaps 57 between the non-terraced flat portions 53 of the thus obtained heat exchange unit 50, in the vicinity of the openings 55*a*. The serration portion 10*d* of the inner plate section 10*b* is also inserted into the gaps in the vicinity of the end of the openings 55*a*. The serration portions 10*c*, 10*d* of the outer and inner plate sections 10*a*, 10*b* are welded at their periphery to the edges of the heat exchange plates 51, which are held between these serration portions.

The serration portions 10*c*, 10*d* having a large thickness of the outer and inner plate sections 10*a*, 10*b* are placed on the opposite sides of the heat exchange plate 51 having a small thickness to provide the heat exchange plate 51 with a large heat input in the welding operation. It is therefore possible to apply a welding method having a high welding speed (such as a MIG welding), although the heat input is increased, thus providing an excellent welding operability. In addition, the heat exchange plate 51 and the plate sections 10*a*, 10*b* are firmly welded together, thus providing a high welding strength.

At this stage, the portions of the heat exchange plates 51 that have been left in the form of unwelded region in the vicinity of openings 55*a* are thermally bonded to the serration portions 10*c*, 10*d* of the outer and inner plate sections 10*a*, 10*b*, without providing clearance between them. As a result, there is no need to apply an additional welding operation to the unwelded region, thus improving the welding operability. In addition, the whole welded portions provide a uniform strength so as to cope surely with a case in which there is a large difference in pressure between the heat exchange fluids, thus enabling an appropriate separation of the fluids to be ensured. The outer and inner plate sections 10*a*, 10*b* are provided in the form of continuous wall on the opposite sides of the welding area. As a result, even when sputters scatter from the welding area during such a welding operation, the above-mentioned continuous wall prevents the sputters from coming into the openings such as the openings 55*a*. Adverse effects of the sputters on the heat transfer areas and the fluid passages can be prevented.

The above-mentioned welding operation provides the corner ridge members 10 to which the outer and inner plate sections 10*a*, 10*b* are connected. Since the corner ridge members 10 are connected also to the heat exchange plates 51, the corner ridge members 10 are connected to the corners of the heat exchange unit 50. Existence of the corner ridge members 10 placed between the opening 55*a* and the opening 56*a* in the heat exchange unit 50 provides an appropriately separated state between the opening 55*a* and the opening 56*a*, without causing them to communicate with each other. In addition, the heat exchange unit 50 is connected to the other structural members serving as an outer shell through the corner ridge members 10 with the result that there is no need to form any projections for connection on the side of the heat exchange unit 50. It is therefore possible to press-form metallic plates having a simple rectangular shape to prepare the heat exchange plates for the heat exchange unit, without applying any additional operation.

Then, the inner plates 11*a* of the end walls 11 are welded to the first opposite planes of the heat exchange unit, which are in parallel with the heat exchange plates 51, respectively. In addition, the inner plates 13 of the first walls 12 are welded to the edges of the corner ridge members 10, which correspond to the other edge of the inner plate section 10*b*, and the upper and lower edges of the inner plate 11*a*. Further, the inner plates 16 of the second walls 15 are welded to the edges of the corner ridge members 10, which correspond to the other edge of the outer plate section 10*a*, and the side edge of the inner plate 11*a*. The inner plates 11*a*, 13 and 16 are placed outside the heat exchange unit 50 in this manner, thus enabling an appropriate separation of the inside of the heat exchange unit from the outside, except for the openings 13*a*, 16*a* of the inner plates 13, 16. The reinforcement members 17, 18 of the second walls 15 are brought into contact with the inner plates 16. The reinforcement members 14 of the first walls 12 are brought into contact with the inner plates 13. The reinforcement members 11*b* of the end walls 11 are brought into contact with the inner plates 11*a*. In such a state, these members are fixed to the reinforcement members 14, 17, 18 through bolts 19, thus providing a finished outer shell for the heat exchanger.

The end wall 11, the first wall 12 and the second wall 15 for forming the outer shell for the heat exchanger 1 have the respective combined structure of the inner plates 11*a*, 13, 16 formed of a thin plate and the reinforcement members 11*b*, 14, 17, 18 that are placed on the respective peripheral portions of these inner plates and have a sufficient strength. It is therefore possible to weld easily the inner plates 11*a*, 13, 16 to the respective corner ridge members 10 and the other plates. Any desired material can be used as the reinforcement members 11*b*, 14, 17, 18, without taking account whether or not it is weldable to the heat exchange unit. The different material from the heat exchange plates 51 may be used as material for forming the reinforcement members 11*b*, 14, 17, 18. Selection of an appropriate material having a sufficient strength, an excellent corrosion resistance to the heat exchange fluids and a low cost permits to reduce costs for the whole heat exchanger 1.

According to the heat exchanger 1, a proper setting of position and size of the holes 13*a*, 16*a* of the inner plates 13, 16 of the first and second walls 12, 15 provide an easy and flexible design in setting of the inlet and outlet for the heat exchange fluids, thus permitting to cope with heat exchange systems for different use. The flanges 13*c*, 16*c* exposed outside of the reinforcement members 14, 17, 18 are used to install actually the heat exchanger 1 and connect the pipes for supplying and discharging the heat exchange fluids, thus enhancing the support strength and facilitating the connection operation.

In the heat exchanger 1, the heat exchange fluid is caused to flow in the first gap portions 55 through the hole 13*a* and the respective openings 55*a* and the other heat exchange fluid is caused to flow in the second gap portions 56 of the heat exchange unit 50 through the hole 16*a* and the respective openings 56*a*, so as to make heat exchange between the two kinds of heat exchange fluids. The other heat exchange fluid flows in the vertical direction in the second gap portions 56, while supplying and discharging it to and from the openings 56*a*, so that the other heat exchange fluid flows from the hole 16*a* at one end in the vertical direction to the hole 16*a* at the other end. The other heat exchange fluid flowing in the second gap portions 56 and the heat exchange fluid flowing in the vertical direction in the first gap portions 55 on the opposite side of the heat exchange fluid relative to the heat exchange plate 51 provide a flowing relationship based on a parallel flowing system or a counter-flowing system.

When the heat exchanger 1 is used for the heat exchange fluids, which are considerably different in pressure from each other, pressure from the heat exchange fluid is applied to the heat exchange unit 50, the end walls 11, the first walls 12 and the second walls 15. However, there is recognized no deformation due to the pressure in the heat exchange unit 50 in which the heat exchange unit 50 is welded to the corner ridge members 10, in addition to connection of the heat exchange plates by welding, to provide a high connection strength, thus enabling an appropriate separation of the gap portions 55, 56 to be ensured. Further, the end walls 11, the first walls 12 and the second walls 15 have the combined structure in which the welded inner plates 11*a*, 13, 16 are supported by the reinforcement members 11*b*, 14, 17, 18 that are connected from the outside to the inner plates, thus causing neither deformation nor displacement and enabling an appropriate separation of the fluids to be ensured.

The gap closure members 58 close the gap between the heat exchange unit 50 and the inner plates 16 of the second walls 15. Even when the positions of the holes 16*a* in the inner plate 16 that serve as the inlet and outlet for the other heat exchange fluid flowing in the second gap portions 56 are spaced apart from each other by a long distance in the vertical direction of the heat exchange unit 50, there occurs no flow of the heat exchange fluid that flows from the second gap portion 56 to the gap portion along the inner plate 16. It is therefore possible to cause the other heat exchange fluid to flow in the second gap portion 56 to make an appropriate heat exchange between the other heat exchange fluid and the heat exchange fluid flowing through the first gap portion 55. In addition, the gap closure members 58 come into contact with the heat exchange unit 50, while closing the gap, the shape of the gap does not easily vary, thus improving resistance to deformation due to pressure from the fluid and enhancing the strength of the heat exchanger 1.

According to the outer shell structure for the heat exchanger of the embodiment of the present invention, in the heat exchange unit 50 into which the heat exchange plates 51 are placed in parallel with each other and welded together at the opposite edges thereof, the outer and inner plate sections 10*a*, 10*b* with the serration portions 10*c*, 10*d* having the corresponding shapes to the inner and outer sides of the edges, which define the first gap portions 55 are welded to the heat exchange unit 50 together with the heat exchange plates 51 to provide the corner ridge members 10 connected to the heat exchange unit 50. There are provided the end walls 11 that are connected to the corner ridge members 10 so as to be placed along the outermost plates of the heat exchange unit 50, the first walls 12 for covering the openings 55*a* of the first gap portions 55 and the second walls 15 for covering the openings 56*a* of the second gap portions 56. The corner ridge members 10, the end walls 11, the first walls 12 and the second walls 15 are connected to each other so as to surround the heat exchange unit 50. It is therefore possible to separate reliably the heat exchange unit 50 from an outside through a simple structure in which the heat exchange unit 50 is surrounded with the end walls 11 and the first and second walls 12, 15 firmly secured to each other at corners of the heat exchange unit 50. The heat exchanger 1 can therefore be composed of the heat exchange unit 50 and the minimum number of outer shell sections, without upsizing the heat exchanger, thus permitting to make the heat exchanger 1 compact.

In the outer shell structure for a heat exchanger according to the embodiment of the present invention as described above, the inner plate 16 of each of the second walls 15 is provided with the single hole 16*a* corresponding to the respective plane of the heat exchange unit. However, the present invention is not limited only to such an embodiment and the inner plate 16 may be provided with a plurality of holes communicating with the openings 56*a*. In an example case in which holes (not shown), pipes 16*b* and flanges 16*c* are provided on the longitudinal opposite sides of the respective inner plate 16 in the vicinity of the first wall 12, to provide four holes for the opposite planes of the heat exchange unit so that the other heat exchange fluid flows from the two holes at the one end in the longitudinal direction of the heat exchange unit to the two holes at the other end therein, it is possible not only to cause the other heat exchange fluid to flow in the second gap portions 56 in the vertical direction, while supplying and discharging the same fluid to and from the openings 56*a*, but also to cause the fluid to flow over the entire zone of the second gap portions, thus further improving heat exchange performance.

In the outer shell structure for a heat exchanger according to the embodiment of the present invention as described above, the reinforcement members 14 of the first walls 12 and the reinforcement members 17, 18 of the second walls 15 are divided into a plurality of parts so as to be secured easily to the inner plates 13, 16 provided with the pipes and the flanges, these divisional parts are combined to cover the inner plates 13, 16, and these parts have at their joined portion the cutoffs 14*a*, 17*a*, 18*a* for forming access areas through which the pipes 13*b*, 16*b* are inserted. However, the present invention is not limited only to such an embodiment and the reinforcement member may be provided in the form of a single part that has only a hole through which the pipe 13*b*, 16*b* can be inserted. In this case, forming the flange 13*c*, 16*c*, which is provided at the edge of the pipe 13*b*, 16*b*, separately from the pipe suffices to connect the flange to the pipe after fixing the reinforcement member to the outer surface of the inner plate. In addition, the reinforcement member provided on the upper side of the inner plate may be divided into three or more parts, so as to cope with a case in which the number of the pipes and the flanges on the inner plate is increased.

Second Embodiment of the Present Invention

Figure 12:
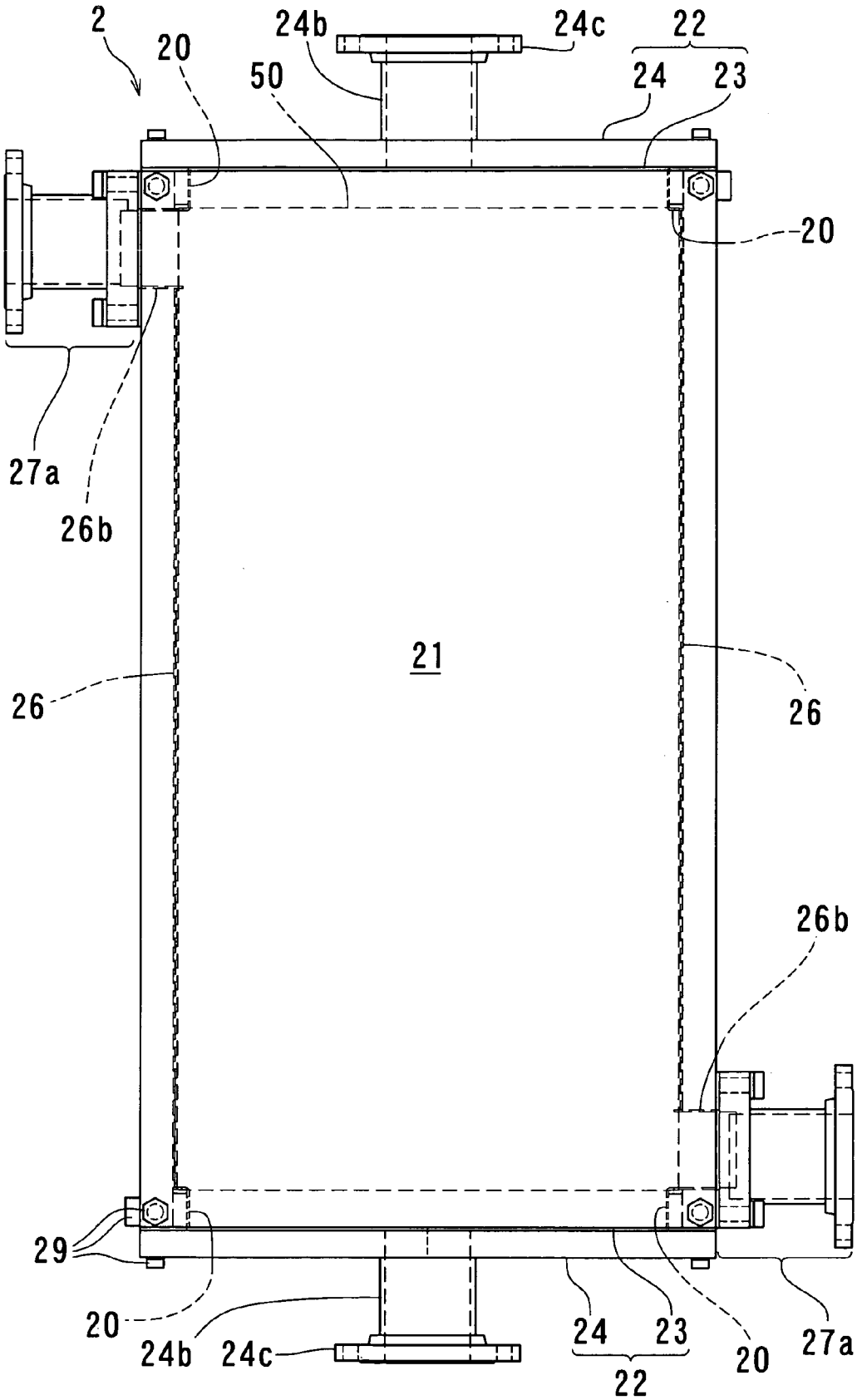
FIG. 12 is a front view of the heat exchanger according to the second embodiment of the present invention.
Figure 13:
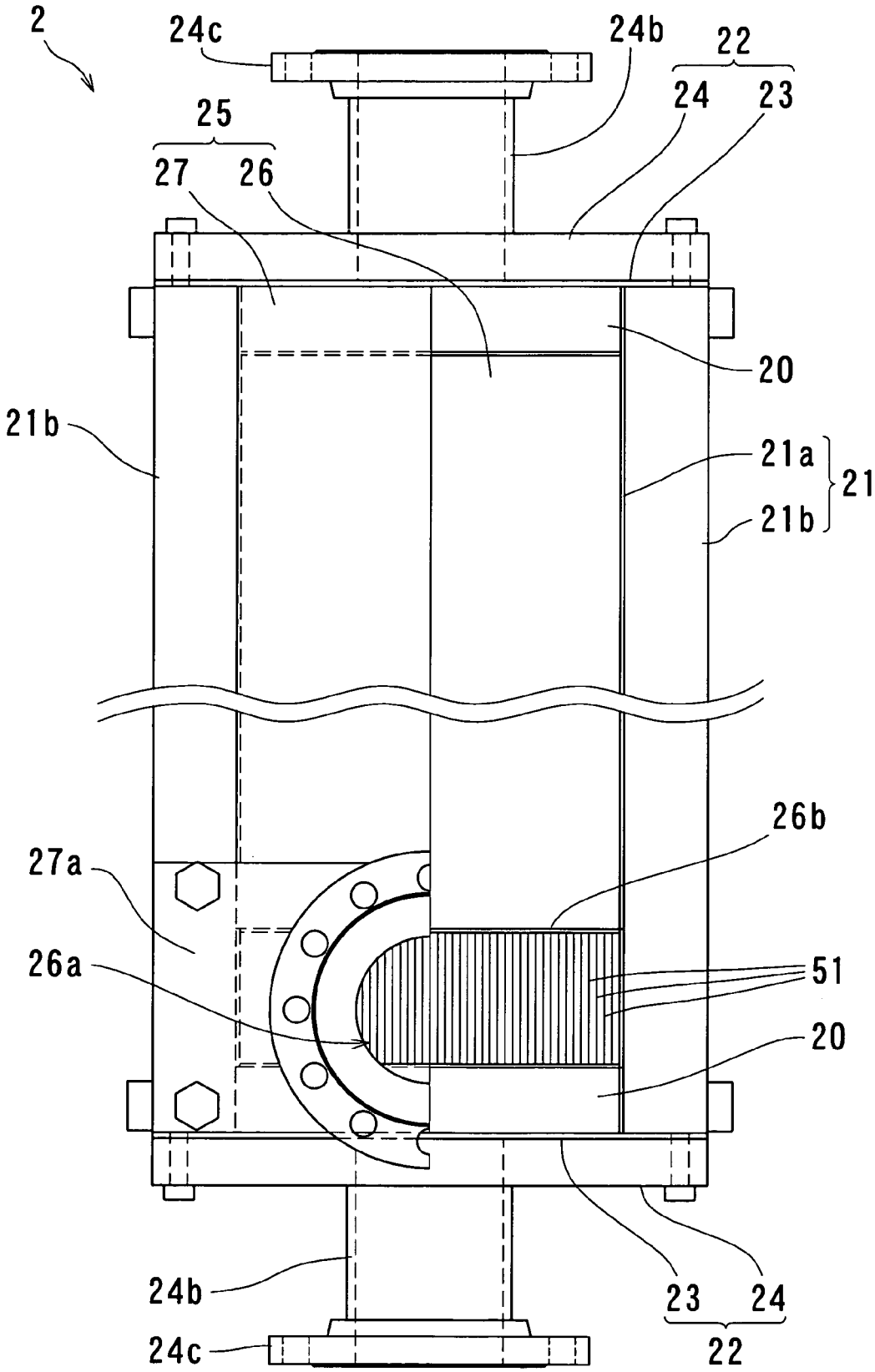
FIG. 13 is a partial right-hand side view of the heat exchanger according to the second embodiment of the present invention.
Figure 14:
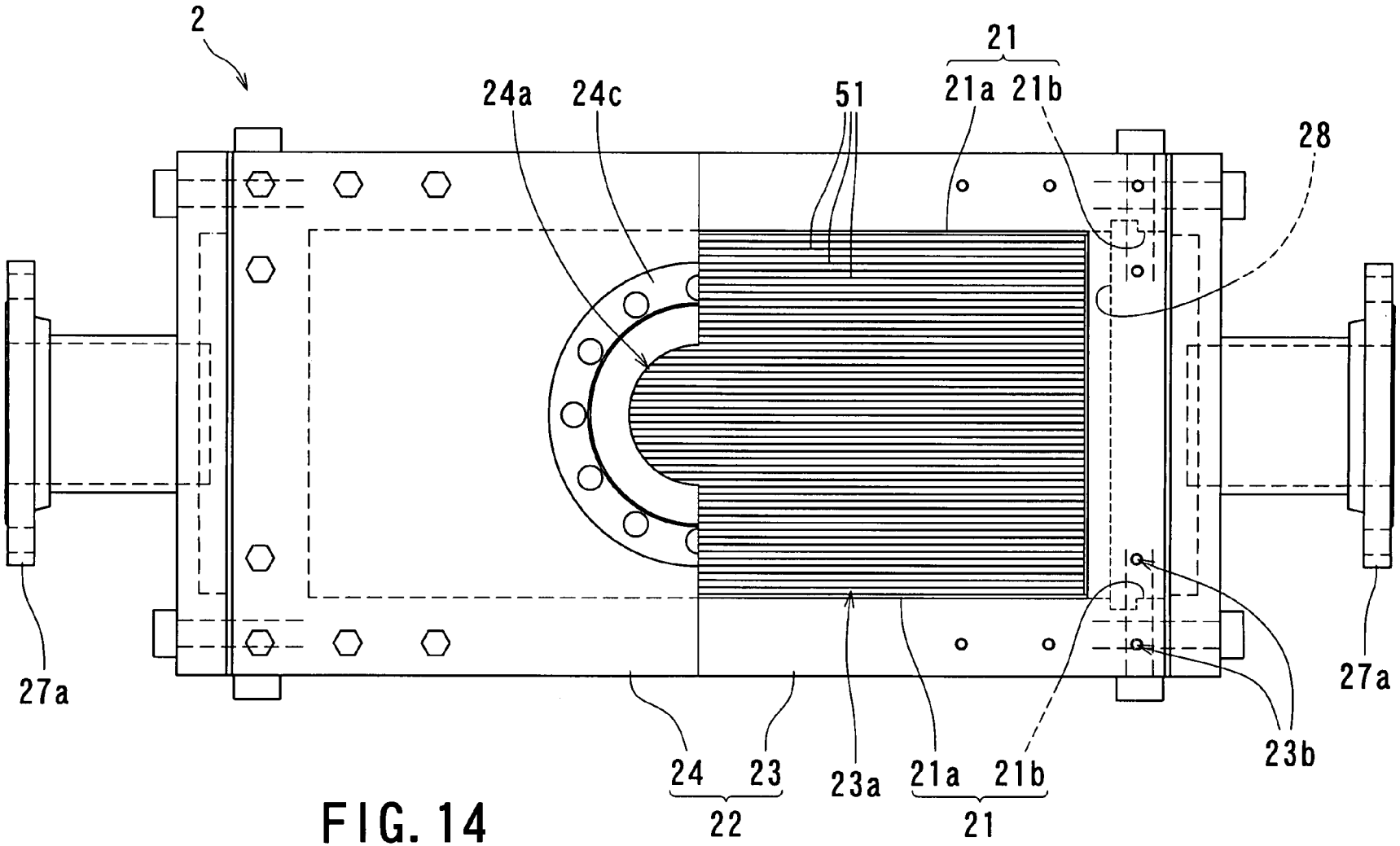
FIG. 14 is a partial bottom view of the heat exchanger according to the second embodiment of the present invention.
Figure 15:
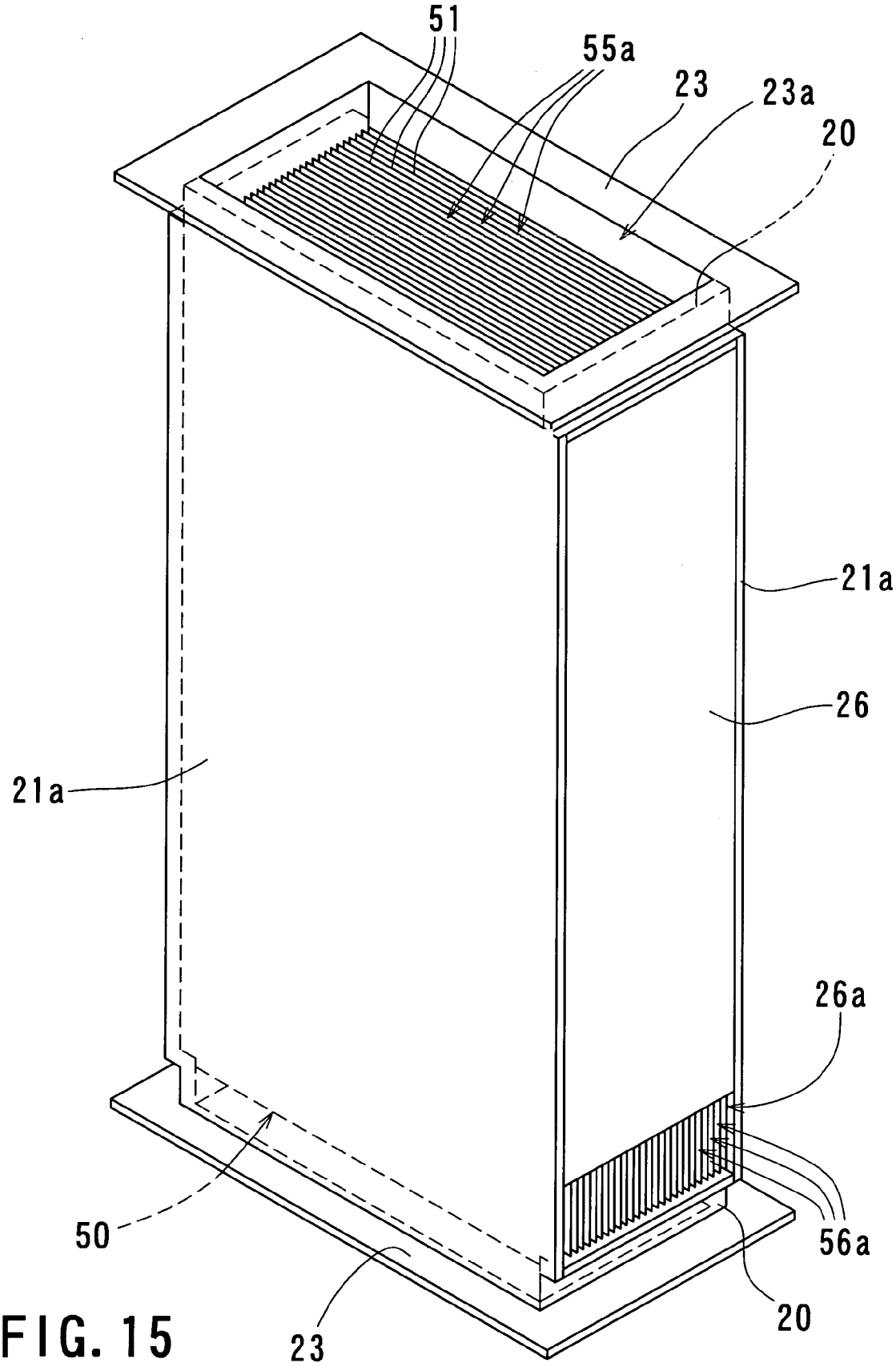
FIG. 15 is a descriptive view illustrating a state in which the corner ridge member and the inner plate are connected to the heat exchange unit of the heat exchanger according to the second embodiment of the present invention.
Figure 16:
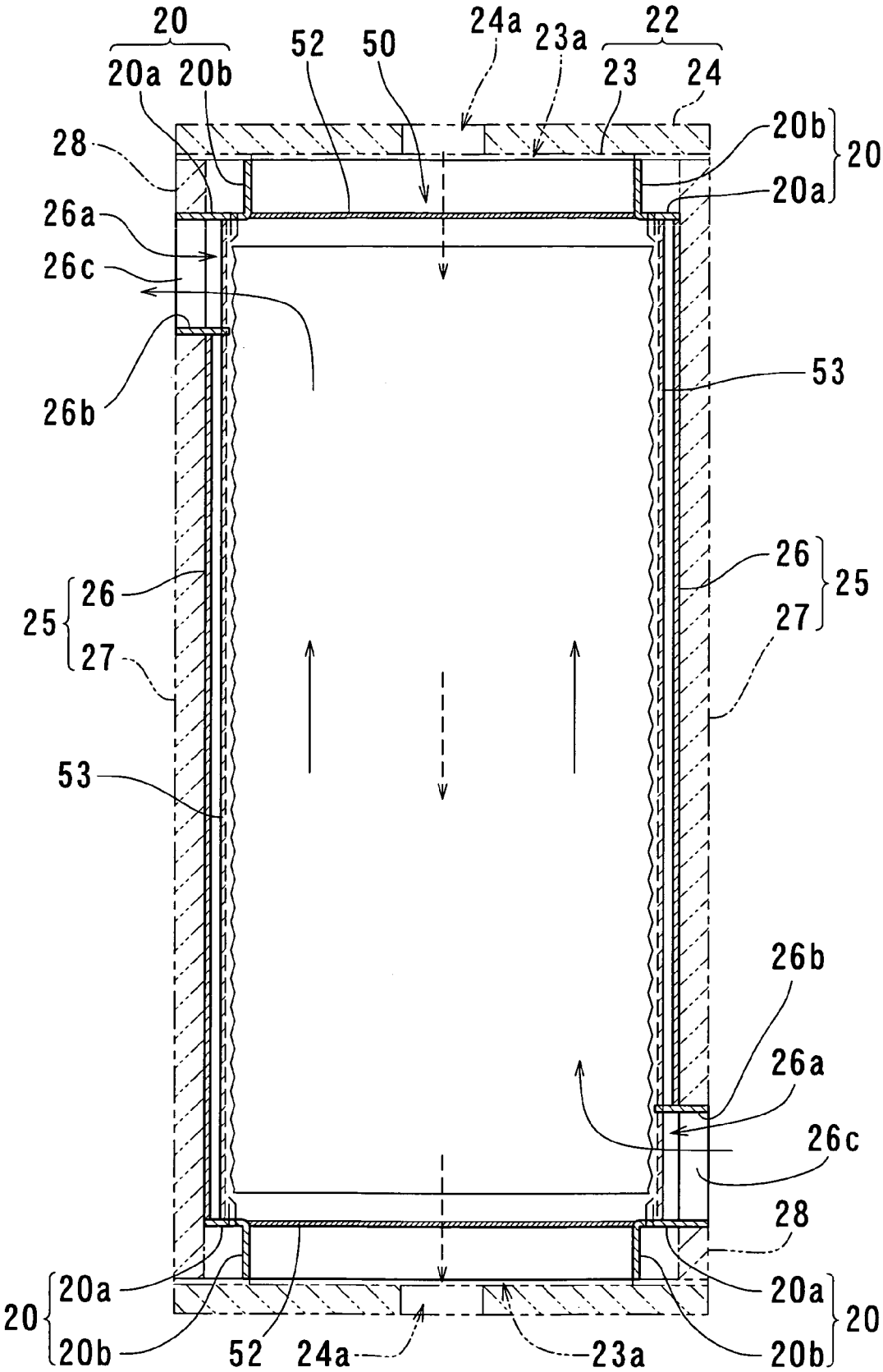
FIG. 16 is a schematic descriptive view of flow of a liquid in the second gap portion of the heat exchanger according to the second embodiment of the present invention.

Now, the second embodiment of the present invention will be described in detail below with reference to FIGS. 12 to 16. FIG. 12 is a front view of the heat exchanger according to the second embodiment of the present invention; FIG. 13 is a partial right-hand side view of the heat exchanger according to the second embodiment of the present invention; FIG. 14 is a partial bottom view of the heat exchanger according to the second embodiment of the present invention; FIG. 15 is a descriptive view illustrating a state in which the corner ridge member and the inner plate are connected to the heat exchange unit of the heat exchanger according to the second embodiment of the present invention; and FIG. 16 is a schematic descriptive view of flow of a liquid in the second gap portion of the heat exchanger according to the second embodiment of the present invention.

As shown in these figures, the outer shell structure for a heat exchanger 2 according to the second embodiment of the present invention includes corner ridge members 20, a pair of end walls 21, a pair of opposite first walls 22 with an opening and a pair of opposite second walls 25 with an opening in the same manner as the first embodiment of the present invention. The corner ridge members 20, the end walls 21, the first walls 22 and the second walls 25 are placed around a heat exchange unit into which a plurality of heat exchange plates 51 formed of a metallic plate are placed in parallel with each other and welded together. However, the first walls 22 and the second walls 25 that relate to the inlet and outlet for the heat exchange fluids have the different structure from that of the first embodiment. The heat exchange plates 51 and the heat exchange unit 50 into which these heat exchange plates 51 are combined parallelly together are the same as those in the first embodiment as described above of the present invention, and description thereof will be omitted.

The corner ridge member 20 is welded to the respective plates in a state in which an outer plate section 20*a* and an inner plate section 20*b* with respective serration portions (not shown) are inserted into the opposite sides of the openings 55*a* of the first gap portions 55 of the heat exchange unit 50 and the gaps 57 placed outside thereof, in the same manner as the first embodiment as described above of the present invention. The second embodiment of the present invention is different from the first embodiment thereof in that the former has a structure in which there is increased a projection amount by which some of the corner ridge members 20 project from the edges of the plates 51 in a state in which the opposite edge to the serration portion of the outer plate section 20*a* is placed in a predetermined region of the above-mentioned gap 57 into which the serration portion is to be inserted.

The edge of the second wall is placed apart from the edge of the corner ridge member 20 having an increased projection amount, by the predetermined distance, resulting in formation of a hole 26*a* that serves as the inlet and outlet for the other heat exchange fluid. No existence of edge of the second wall 25 in the vicinity of the corner ridge member 20 causes formation of a space in the vicinity of the corner ridge member 20. There is placed in this space a corner support member 28 that firmly connects the end wall 21 and the first wall 22 to the heat exchange unit 50 without applying the welding method. The corner support member 28 is of a metallic square pillar having a length, which is substantially the same as the width of the heat exchange unit 50 in the direction along which the heat exchange plates are placed. The corner support member 28 is placed in the vicinity of the corner ridge member 20, but is not welded directly thereto. More specifically, the corner support member 28 is connected to the end wall 21 and the first wall 22 by means of bolts to provide a combined unit of the corner ridge member 20, the heat exchange unit 50 and the corner support member 28.

The above-mentioned end wall 21 has a combined structure of two plates, i.e., an inner plate 21*a* and a reinforcement member 21*b* in the same manner as the first embodiment of the present invention as described above. The end walls 21 are placed on the pair of first opposite planes of the heat exchange unit 50 that are in parallel with the heat exchange plates 51, respectively, so as to cover the pair of first opposite planes thereof. The second embodiment of the present invention is different from the first embodiment of the present invention in that the former has a structure in which the longitudinal distance of the reinforcement member 21*b* is decreased by the thickness of the first wall 22 in accordance with the structure of the first wall 22.

The first wall 22 has a combined structure of two plates, i.e., an inner plate 23 and a reinforcement member 24 in the same manner as the first embodiment of the present invention as described above. The first walls 22 are placed on the pair of second opposite planes of the heat exchange unit 50 that are placed on the opening sides 55*a* of the first gap portions 55, respectively, so as to cover the pair of second opposite planes thereof from the outside. The second embodiment of the present invention is different from the first embodiment of the present invention in that the former has a structure in which the inner plate 23 is in the form of a framework to provide a wide opening and the reinforcement member 24 has a hole that specifically defines the inlet and outlet for the heat exchange fluid.

The inner plate 23 is formed of the same metallic thin plate as the inner plate 21 of the end wall 21. The inner plate 23 has a long side with a length, which is substantially the same as the lateral length of the reinforcement member 21*b* of the end wall 21, and a short side with a length, which is substantially the same as the total length of the width of the heat exchange unit 50 in the direction along which the plates are aligned, and the length twice as much as the thickness of the end wall 21. The inner plate 23 is provided in a form of a rectangular framework having a central opening 23*a* that is substantially the same as the second opposite planes of the heat exchange unit 50 that are placed on the opening sides 55*a* of the first gap portions 55. The inner plate 23 is welded water-tightly at a peripheral portion of the central opening 23*a* to the inner plate section 20*b* of the corner ridge member 20 and the inner plate 21*a* of the end wall 21. The inner plate 23 is formed with holes 23*b* into which bolts 29 for fastening the reinforcement member 24 are inserted.

The reinforcement member 24 has substantially the same external shape as the inner plate 23 and is formed of a metallic thick plate, which provides substantially same strength as the reinforcement member 21*b* of the end wall 21. The reinforcement member 24 is detachably placed on the inner plate 23 so as to come water-tightly into contact with the inner plate 23 from the outside thereof. The reinforcement member 24 has an opening 24*a* at a position corresponding to the central opening 23*a* of the inner plate 23. The reinforcement member 24 covers the central opening 23*a* of the inner plate 23 and the respective openings 55*a* at the end plane of the heat exchange unit 50, which are placed inside the inner plate 23, except for the opening 24*a*. A pipe 24*b* through which the heat exchange fluid is introduced is connected to the opening 24*a* of the reinforcement member 24. The pipe 24*b* is provided at an end thereof with a flange 24*c* to which a supply/discharge pipe for the fluid is connected. The reinforcement member 24 is firmly connected not only to the inner plate 23, but also to the corner support member 28 and the reinforcement member 21*b* of the end wall 21 by means of bolts 29.

The second wall 25 has a combined structure of two plates, i.e., an inner plate 26 and a reinforcement member 27 in the same manner as the first embodiment of the present invention as described above. The second walls 25 are placed on the pair of third opposite planes of the heat exchange unit 50 that are placed on the opening sides 56*a* of the second gap portions 56, respectively, so as to cover the pair of third opposite planes thereof from the outside. In the second embodiment, the inner plate 26 and the reinforcement member 27 have different shapes from those in the first embodiment of the present invention.

The inner plate 26 is formed of the same metallic thin plate as the end wall 21 and the inner plate 21*a*, 23 of the first wall 22 in the first embodiment of the present invention. The second embodiment of the present invention is different from the first embodiment thereof in that the former has a structure in which the inner plate 26 has a rectangular shape with a longitudinal side, which is shorter than the heat exchange unit 50, has no hole formed therein, serving as the inlet and outlet for the fluid, the inner plate 26 is welded at one edge thereof to, of two corner ridge members 20 placed on the opposite sides of the openings 56*a* in the longitudinal direction thereof, one corner ridge member 20 whose portion corresponding to the other end of the outer plate section 10*a* has a smaller amount of projection in the lateral direction, and welded at the other two edges thereof, which is perpendicular to eth above-mentioned one edge of the inner plate 26, to the side edge of the inner plate 21*a* of the end wall, and welded water-tightly to the heat exchange unit 50 so as to cover the respective openings 56*a* except for a part thereof from the outside.

The other edge of the inner plate 26, which is in parallel with the above-mentioned one edge thereof is placed in a predetermined position along the edge of the heat exchange unit 50, so as to be apart from the corner ridge member 20 in which a projection amount of a portion corresponding to the other edge of the outer plate section 20*a* is increased. The inner plate 26 is generally deviated from any one of the longitudinal edges of the heat exchange unit 50. More concretely, the inner plates 26 are placed on the upper side of the heat exchange unit 50 on one of the planes, and on the lower side thereof on the other plane, respectively.

A releasing zone between the other edge of the inner plate 26 and the corner ridge member 20, which are not welded together, forms the hole 26*a* that serves as the inlet and outlet for the other heat exchange fluid, which communicates with the second gap portions 56 through the openings 56*a*. The inner plate 26 covers the respective openings 56*a* except for the above-mentioned hole 26*a* to provide an appropriate separation of the second gap portions 56 from the outside. In addition, a gap closure member (not shown) that closes the gap formed between the inner plate 26 and the heat exchange unit 50 so as to continuously extend in the longitudinal direction of the unit, to prevent the heat exchange fluid from flowing into this gap is provided in the inside of the inner plate 26. A guide plate 26*b* having at its one end a serration portion (not shown) corresponding to the shape that conforms to the gaps 57 formed between the non-terraced flat portions 53 of the heat exchange unit 50 on the side plane thereof is welded to the other edge of the inner plate 26, so as to form a part of a pipe section for introducing the heat exchange fluid without causing leak between the hole 26*a* and the outside.

The reinforcement member 27 is formed of a metallic thick plate, which provides substantially same strength as the reinforcement member 21*b* of the end wall 21. The reinforcement member 27 has a size obtained by adding the rectangular area corresponding to the longitudinal length of the corner ridge member 20 to the same rectangular shape as the inner plate 26 at the longitudinal edge thereof. The reinforcement member 27 is placed so as to come into contact with the inner plate 26 from the outside and is connected at its respective edges to the other reinforcement members 21*b*, 24. The reinforcement member 27 does not extend into the hole 26*a* formed between the non-welded side edge of the inner plate 26 and the corner ridge member 20, so as to expose the hole 26*a* to the outside without narrowing the hole 26*a*.

Not only the laterally projecting portion of the corner ridge member 20 and the guide plate 26*b*, but also an extension plate 26*c* connected water-tightly to the inner plate 21*a* of the end wall 21 is placed on the periphery of the hole 26*a*, and the corner ridge member 20, the guide plate 26*a* and the extension plate 26*c* are welded water-tightly to each other to form a pipe section through which the heat exchange fluid is introduced. The pipe section is provided at its top end with a flange 27*a* to which a supply/discharge pipe for the heat exchange fluid is to be connected.

Now, description will be given below of steps for manufacturing the outer shell structure for a heat exchanger according to the second embodiment of the present invention. The assembling steps of the heat exchange unit 50 are the same as those mentioned in the first embodiment of the present invention and description of these assembling steps is therefore omitted.

The serration portion of the outer plate section 20*a* for forming the corner ridge member 20 is inserted into the gap 57 between the non-terraced flat portions 53 on the opposite sides of the heat exchange unit 50 as obtained, in the vicinity of the edge of the opening 55*a*, and the serration portion of the inner plate section 20*b* is inserted into the gap 57 in the vicinity of the side edge of the opening 55*a*. The serration portions as inserted of the plate sections 20*a*, 20*b* are welded to the edges of the heat exchange plates 51, with which the serration portions are engaged. The welding operation as carried out in the same manner as the first embodiment of the present invention firmly combines the heat exchange plates 51 with the plate sections 20*a*, 20*b*, and the corner ridge member 20 with which the plate sections 20*a*, 20*b* are combined is obtained.

The respective corner ridge members 20 are combined to the corners of the heat exchange unit 50 by the welding operation, with the result that the corner ridge member 20 is placed between the opening 55*a* and the opening 56*a*, thus enabling an appropriate separation between the opening 55*a* and the opening 56*a* to be ensured, without causing them to communicate with each other. Then, the inner plate 26 of the second wall 25 is welded to the corner ridge member 20 on one side of each of the third opposite planes of the heat exchange unit that are placed on the opening sides of the above-mentioned second gap portions 56. The inner plate 21*a* of the end wall 21 is welded to the corner ridge member 20 and the inner plate 26. Further, the inner plate 23 of the first wall 22 is welded to the inner plate 21*a* and the edge of the respective corner ridge member 20, which corresponds to the other end of the inner plate section 20*b*, so that the respective inner plates 21*a*, 23, 26 are placed outside the heat exchange unit 50. There is ensured an appropriate separation of the heat exchange unit 50 from the outside, except for the hole 26*a* between the corner ridge member 20, on the one hand, and the central opening 23*a* and the inner plate 26, on the other hand. The corner support member 28 is placed in the vicinity of the corner ridge member 20 and the reinforcement member 27 of the second wall 25 comes into contact with the inner plate 26. Then, the reinforcement member 21*a* of the end wall 21 and the reinforcement member 24 of the first wall 22 are fixed to the corner support member 28 and the reinforcement member 27, respectively, thus providing a finished product of the outer shell structure for a heat exchanger.

In the heat exchanger 2, it is possible to make a setting design of the inlet and outlet for the heat exchange fluid in an easy and flexible manner by appropriately setting a place and a size of a released area between the corner ridge member 20 and the non-welded edge of the inner plate 26 of the second wall 25, thus coping with heat exchange for various purposes. The heat exchanger 2 enables heat exchange to be made between the two kinds of heat exchange fluids by supplying the heat exchange fluid into the first gap portions 55 of the heat exchange unit 50 through the opening 24*a*, the central opening 23*a* and the respective openings 55*a*, while supplying the other heat exchange fluid into the second gap portions 56 through the hole 26*a* and the respective openings 56*a*. It is possible to cause the other heat exchange fluid to flow in the vertical direction in the second gap portions 56 from the hole 26*a* at the longitudinal one end of the heat exchanger to the hole 26*a* at the other end thereof, so as to provide a flowing relationship between the heat exchange fluid flowing vertically in the first gap portions 55 and the other heat exchange fluid flowing in the second gap portions 56, based on a parallel flowing system or a counter-flowing system.

Although pressure from the heat exchange fluids is applied to the heat exchange unit 50, the end walls 21, the first walls 22 and the second walls 25 in use of the heat exchanger, there is recognized no deformation of the heat exchange unit 50 in the same manner as the first embodiment of the present invention as described above, thus enabling an appropriate separation between the gap portions 55, 56 of the heat exchange unit 50 to be ensured. In addition, neither deformation nor displacement is caused in the end walls 21, the first walls 22 and the second walls 25 each having the combined structure in which the respective inner plates 21*a*, 23, 26 as welded are supported by means of the reinforcement members 21*b*, 24, 27 from the outside, respectively, enabling an appropriate separation of the gap portions 55, 56 from the outside to be ensured.

The first wall 22 is composed of the inner plate 23 having the framework shape, which is welded to the heat exchange unit 50, and the reinforcement member 24, which is placed outside the inner plate 23 and has a sufficient strength, and the reinforcement member 24 is detachable from the inner plate 23. It is therefore possible to expose the opening 55*a* with the size of the central opening 23*a* of the respective inner plate 23 in a state in which the reinforcement member 24 is removed, thus forming a sufficiently wide opening on the respective planes of the heat exchange unit 50, from which the heat exchange plates are exposed to the outside. This makes it possible to carry out appropriately maintenance operations such as a cleaning operation of the heat exchange plates, without disassembling the heat exchange unit 50. There is therefore provided not only a strong structure having an excellent pressure-resistant property by the welding operation, but also an excellent serviceability.

According to the outer shell structure for a heat exchanger according to the second embodiment of the present invention, each of the second walls 25 for covering the pair of third opposite planes of the heat exchange unit 50, which are located on the sides of the openings 56*a* sides of the second gap portions 56, is composed of the inner plate 26 that is welded to the corner ridge member 20 and the inner plate 21*a* of the end wall 21 to cover the major part of the openings 56*a*, and the reinforcement member 27 that is placed outside the inner plate 26 and has a high strength. A released area between the corner ridge member 20 and the non-welded edge of the inner plate 26 of the second wall 25 form the inlet and outlet for the heat exchange fluid. It is therefore possible to make a setting design of the inlet and outlet for the heat exchange fluid in an easy and flexible manner by appropriately adjusting the position of the non-welded edge of the inner plate 26, i.e., the length of the inner plate 26, so as to permit the setting of a flowing relationship between the heat exchange fluids, thus coping with heat exchange for various purposes. In addition, it is possible to apply the welding operation only to the inner plate 26, for connection to the corner ridge member 20 and the end wall 21, the inner plate 26 formed of a thin plate can easily be welded to the respective corner ridge member 20 and the end wall 21. The second wall 25 having the combined structure in which the reinforcement member 27 is secured to the outer surface of the inner plate 26 covering the opening 56*a*, provides a high strength to prevent deformation caused by pressure of the heat exchange fluids, thus ensuring a reliable separation not only between the first gap portions 55 and the second gap portions 56, but also between these gap portions and the outside. In addition, any desired material can be used as the reinforcement members 21*a*, 24, 27, without taking account whether or not it is weldable to the heat exchange unit 50. As a result, use of material having a high strength and a low cost leads to a reduced cost of the whole heat exchanger.

Third Embodiment of the Present Invention

Figure 17:
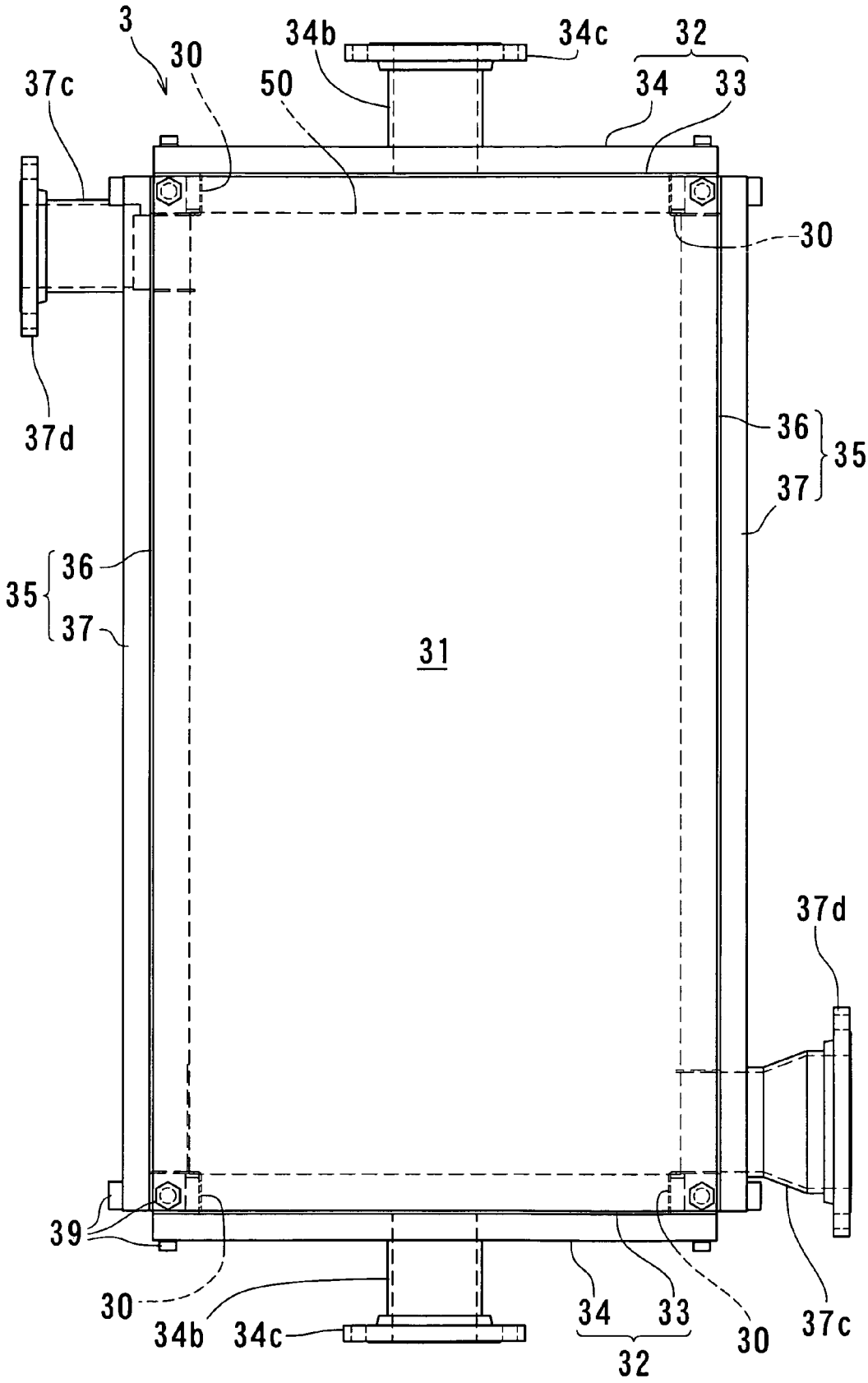
FIG. 17 is a front view of the heat exchanger according to the third embodiment of the present invention.
Figure 18:
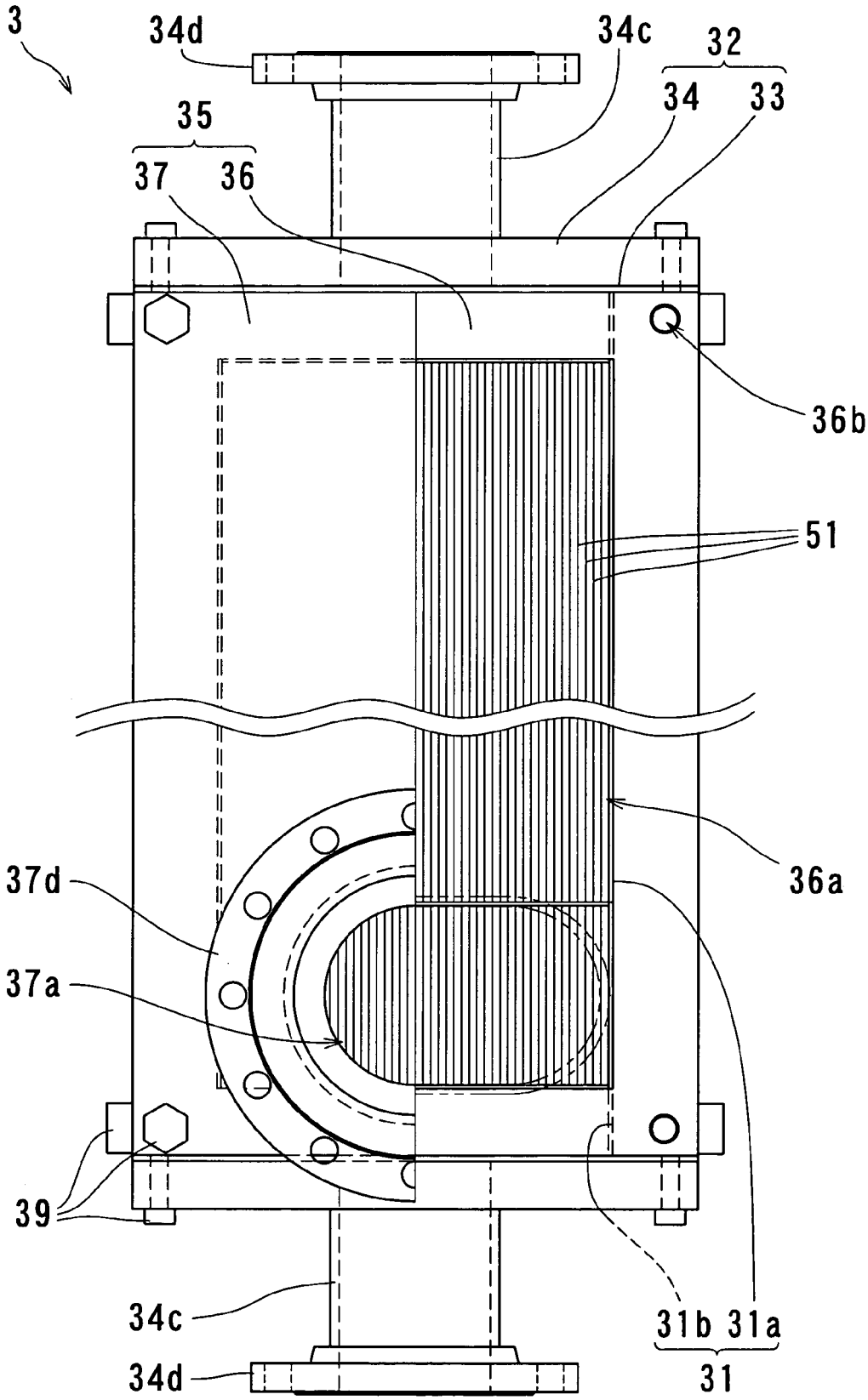
FIG. 18 is a partial right-hand side view of the heat exchanger according to the third embodiment of the present invention.
Figure 19:
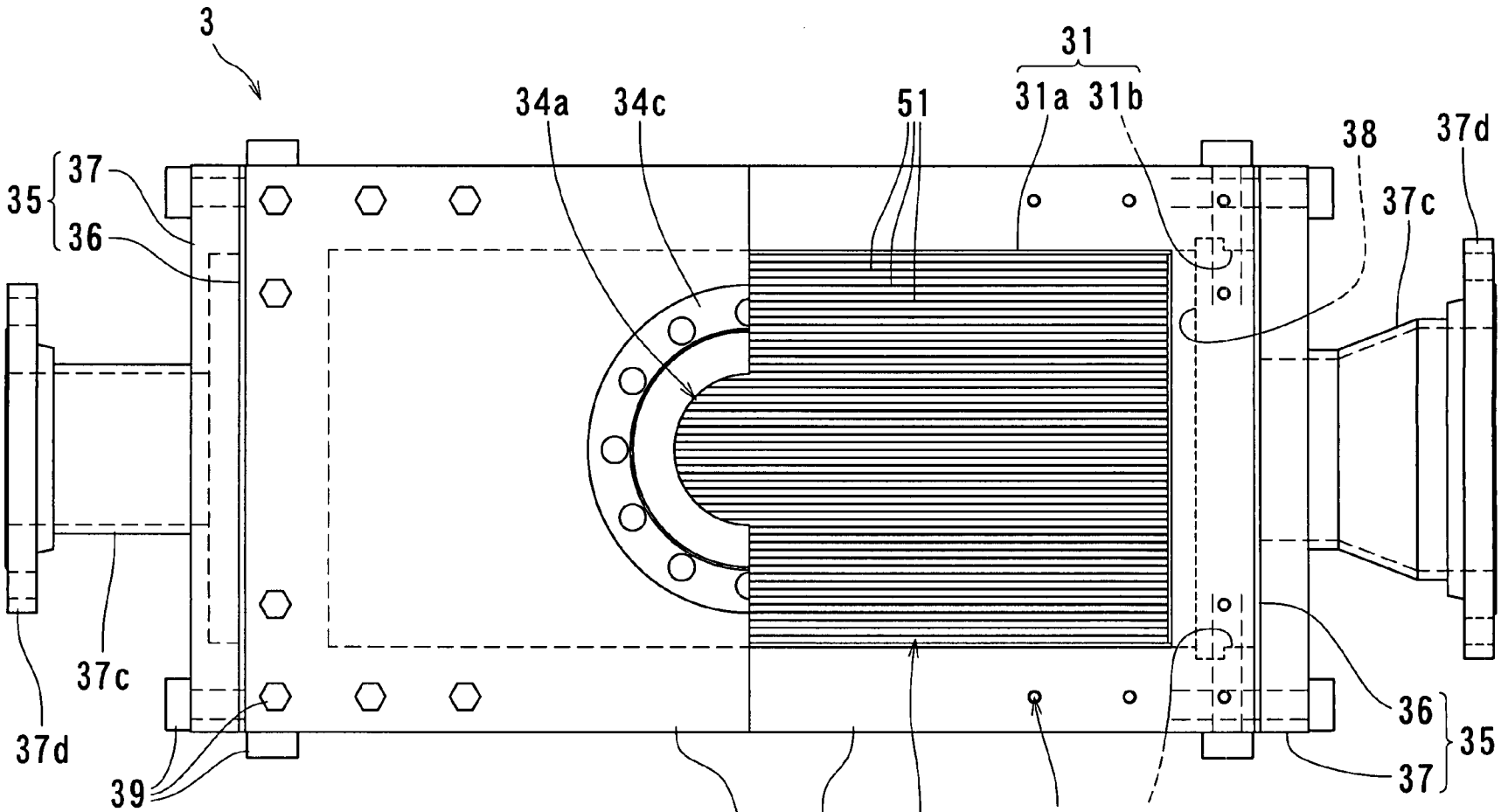
FIG. 19 is a partially enlarged bottom view of the heat exchanger according to the third embodiment of the present invention.
Figure 20:
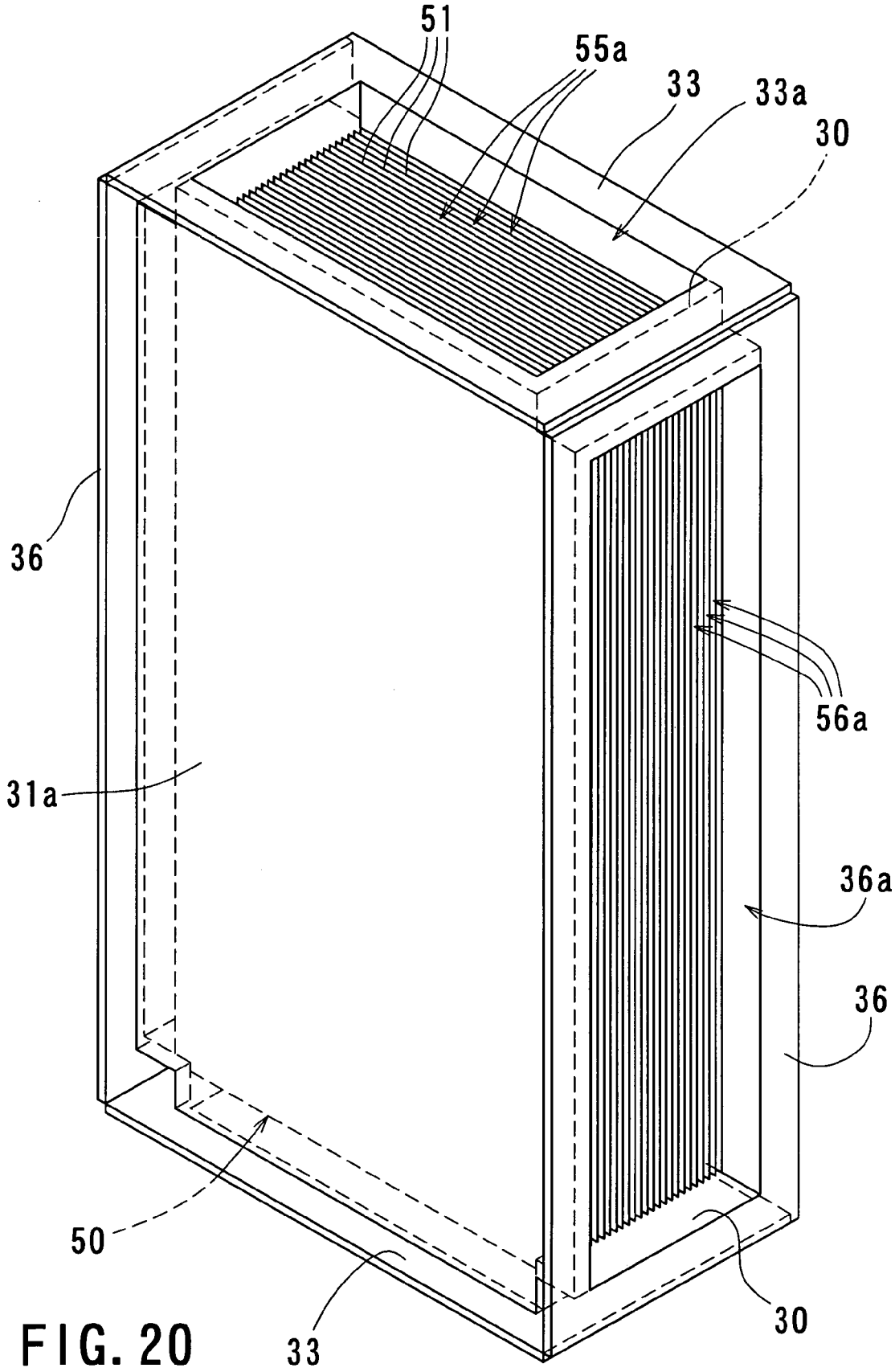
FIG. 20 is a descriptive view illustrating a state in which the corner ridge member and the inner plate are connected to the heat exchange unit of the heat exchanger according to the third embodiment of the present invention.
Figure 21:
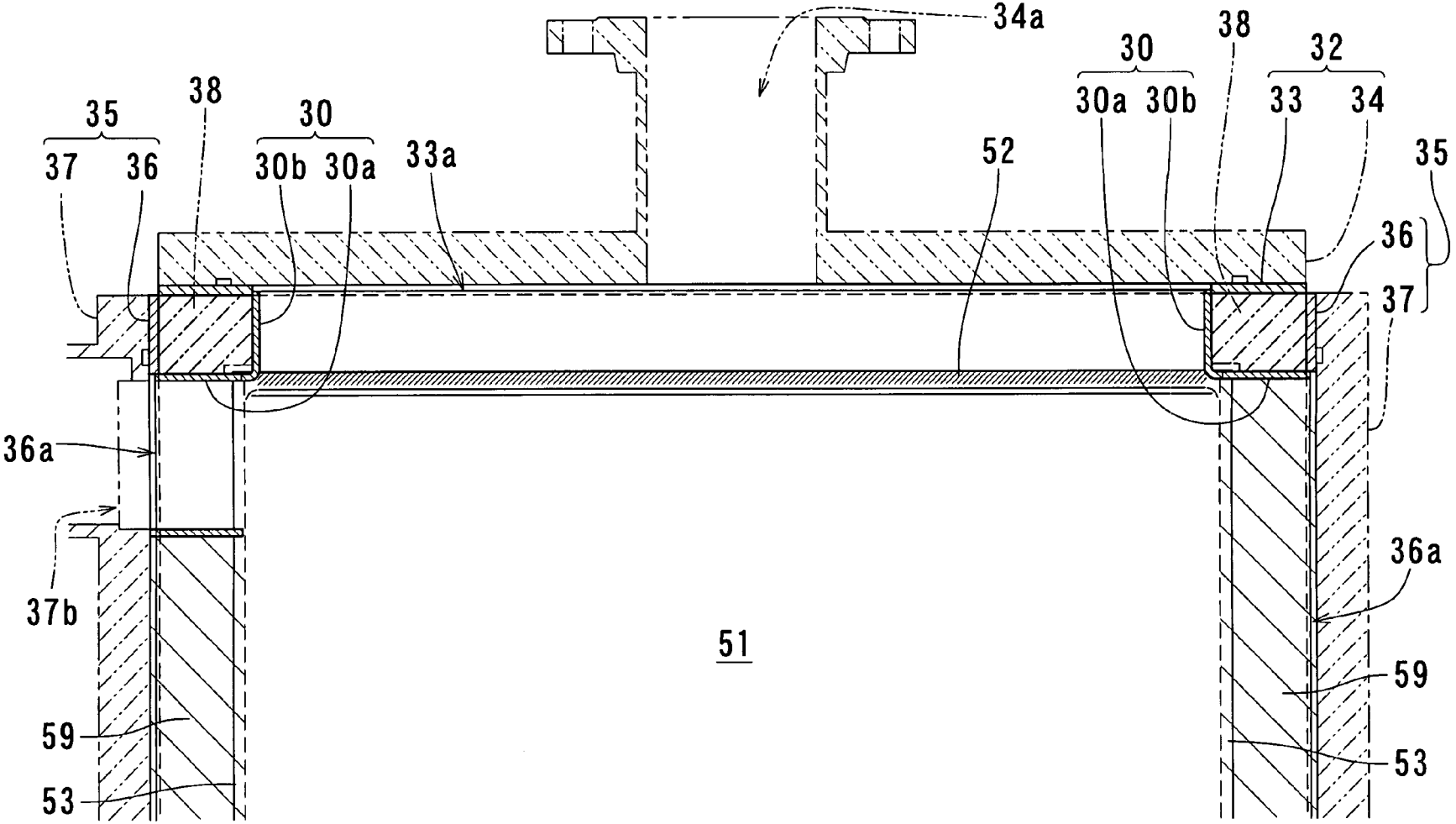
FIG. 21 is a vertical cross-sectional view of an upper side of the heat exchanger according to the third embodiment of the present invention.
Figure 22:
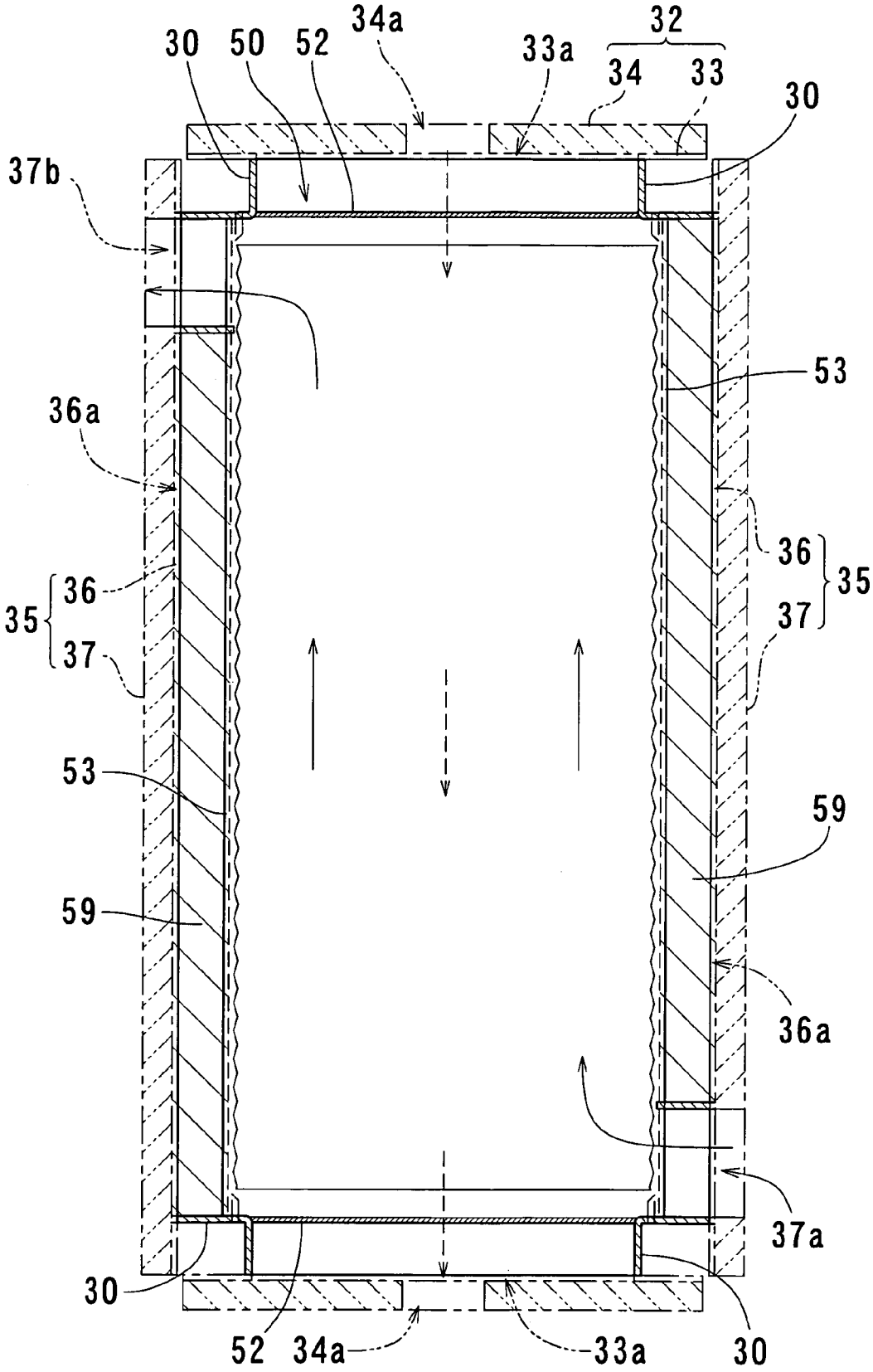
FIG. 22 is a schematic descriptive view of flow of a liquid in the second gap portion of the heat exchanger according to the third embodiment of the present invention.

Now, the third embodiment of the present invention will be described in detail below with reference to FIGS. 17 to 22. FIG. 17 is a front view of the heat exchanger according to the third embodiment of the present invention; FIG. 18 is a partial right-hand side view of the heat exchanger according to the third embodiment of the present invention; FIG. 19 is a partially enlarged bottom view of the heat exchanger according to the third embodiment of the present invention; FIG. 20 is a descriptive view illustrating a state in which the corner ridge member and the inner plate are connected to the heat exchange unit of the heat exchanger according to the third embodiment of the present invention; FIG. 21 is a vertical cross-sectional view of an upper side of the heat exchanger according to the third embodiment of the present invention; and FIG. 22 is a schematic descriptive view of flow of a liquid in the second gap portion of the heat exchanger according to the third embodiment of the present invention.

As shown in these figures, the outer shell structure for a heat exchanger 3 according to the third embodiment of the present invention includes corner ridge members 30, a pair of end walls 31, a pair of opposite first walls 32 with an opening and a pair of opposite second walls 35 with an opening in the same manner as the second embodiment of the present invention. The corner ridge members 30, the end walls 31, the first walls 32 and the second walls 35 are placed around a heat exchange unit. However, the third embodiment is different from the second embodiment in that the second walls 35 have the same structure as the first walls 3. The heat exchange plates 51 and the heat exchange unit 50 into which these heat exchange plates 51 are combined parallelly together are the same as those in the first embodiment as described above of the present invention, and description thereof will be omitted.

The corner ridge member 30 is welded to the respective plates in a state in which an outer plate section 30*a* and an inner plate section 30*b* with respective serration portions (not shown) are inserted into the opposite sides of the openings 55*a* of the first gap portions 55 of the heat exchange unit 50 and the gaps 57 placed outside thereof, in the same manner as the second embodiment as described above of the present invention. The third embodiment of the present invention is different from the second embodiment thereof in that the former has a structure in which there is increased a projection amount by which all the corner ridge members 30 project from the edges of the plates 51 in a state in which the opposite edge to the serration portion of the outer plate section 30*a* is placed in a predetermined region of the above-mentioned gap 57 into which the serration portion is to be inserted.

The second wall is placed at the edge of the corner ridge member 30 having an increased projection amount, resulting in formation of a space in the vicinity of the corner ridge member 30. There is placed in this space a corner support member 38 that firmly connects the end wall 31, the first wall 32 and a part of the second wall 35 to the heat exchange unit 50 without applying the welding method. The corner support member 38 is of a metallic square pillar having a length, which is substantially the same as the width of the heat exchange unit 50 in the direction along which the heat exchange plates are placed. The corner support member 38 is placed in the vicinity of the corner ridge member 30, but is not welded directly thereto. More specifically, the corner support member 38 is connected to the end wall 31, the first wall 32 and the second wall 35 by means of bolts to provide a combined unit of the corner ridge member 30, the heat exchange unit 50 and the corner support member 38.

The above-mentioned end wall 31 has a combined structure of two plates, i.e., an inner plate 31*a* and a reinforcement member 31*b* in the same manner as the second embodiment of the present invention as described above. The end walls 31 are placed on the pair of first opposite planes of the heat exchange unit 50 that are in parallel with the heat exchange plates 51, respectively, so as to cover the pair of first opposite planes thereof. The third embodiment of the present invention is different from the second embodiment of the present invention in that the former has a structure in which the inner plate 31*a* extends to the edge of the corner ridge member 30 in the transverse direction in accordance with the increased projection amount of the corner ridge member 30.

The first wall 32 has a combined structure of two plates, i.e., an inner plate 33 and a reinforcement member 34 in the same manner as the second embodiment of the present invention as described above. The first walls 32 are placed on the pair of second opposite planes of the heat exchange unit 50 that are placed on the opening sides 55*a* of the first gap portions 55, respectively, so as to cover the pair of second opposite planes thereof from the outside. Detailed description of the first wall 32 is omitted.

The second wall 35 has a combined structure of two plates, i.e., an inner plate 36 and a reinforcement member 37 in the same manner as the second embodiment of the present invention as described above. The second walls 35 are placed on the pair of third opposite planes of the heat exchange unit 50 that are placed on the opening sides 56*a* of the second gap portions 56, respectively, so as to cover the pair of third opposite planes thereof from the outside. The third embodiment of the present invention is different from the second embodiment thereof in that the inner plate 36 is in the form of a framework to provide a wide opening in the same manner as the above-described first wall 32, and the reinforcement member 37 has a hole that specifically defines the inlet and outlet for the heat exchange fluid.

The inner plate 36 is formed of the same metallic thin plate as the inner plate 31*a* of the end wall 31 as described above. The inner plate 36 has a long side with a length, which is substantially the same as the longitudinal length of the end wall 31, and a short side with a length, which is substantially the same as the total length of the width of the heat exchange unit 50 in the direction along which the plates are aligned, and the length twice as much as the thickness of the end wall 31. The inner plate 36 is provided in a form of a rectangular framework having a central opening 36*a* that is substantially the same as the third opposite planes of the heat exchange unit 50 that are placed on the opening sides 56*a* of the second gap portions 56. The inner plate 46 is welded water-tightly at a peripheral portion of the central opening 36*a* to the portion corresponding to the other edge of the outer plate section 30*a* of the corner ridge member 30 and the inner plate 31*a* of the end wall 31. The inner plate 36 is formed with holes 36*b* into which bolts 39 for fastening the reinforcement member 37 are inserted.

The reinforcement member 37 has substantially the same external shape as the inner plate 36 and is formed of a metallic thick plate, which provides substantially same strength as the reinforcement member 31*b* of the end wall 31. The reinforcement member 37 is detachably placed on the inner plate 36 so as to come water-tightly into contact with the inner plate 36 from the outside thereof. The reinforcement member 37 has openings 37*a*, 37*b* at the corresponding positions to the central opening 36*a* of the inner plate 36. The reinforcement member 37 covers the central opening 36*a* of the inner plate 36 and the respective openings 56*a* at the end plane of the heat exchange unit 50, which are placed inside the inner plate 36, except for the openings 37*a*, 37*b*. The reinforcement member 37 is firmly connected not only to the inner plate 36, but also to the corner support member 38 and the reinforcement member 31*b* of the end wall 31 by means of bolts 39.

The opening 37*a* of the reinforcement member 37 on the plane of the heat exchange unit 50 is placed on the lower side of the heat exchange unit 50 and the opening 37*b* of the reinforcement member 37 on the other plane of the heat exchange unit 50 is placed on the upper side of the heat exchange unit 50. Pipes 37*c* for introducing the fluid are connected to the holes 37*a*, 37*b*. Each of the pipes 37*c* is provided at its end integrally with a flange 37*b* to which a supply/discharge pipe for the heat exchange fluid is to be connected. In addition, there is provided a gap closure member 59 that closes the gap formed between the portion of the reinforcement member 37, which corresponds to the central opening 36*a*, and the heat exchange unit 50, so as to continuously extend in the longitudinal direction of the unit, to prevent the heat exchange fluid from flowing into this gap, in the same manner as the first and second embodiments of the present invention.

Now, description will be given below of steps for manufacturing the outer shell structure for a heat exchanger according to the third embodiment of the present invention. The assembling steps of the heat exchange unit 50 and the preparation steps of the corner ridge member 30 are the same as those mentioned in the first and second embodiments of the present invention and description of these steps is therefore omitted.

After the corner ridge members 30 are placed at the respective corners of the heat exchange unit 50, the inner plates 31*a* of the end walls 31 are welded to the opposite ends of the corner ridge members 30 in the direction along which the heat exchange plates 51 are placed. The inner plates 33 of the first walls 32 are welded to the edges of the respective corner ridge members 30, which correspond to the other end of the inner plate section 30*b*, and the upper and lower edges of the inner plates 31*a*. The inner plates 36 of the second walls 35 are welded to the edges of the respective corner ridge members 30, which correspond to the other end of the outer plate section 30*a*, and the side edges of the of the inner plates 31*a*. The inner plates 31*a*, 33 and 36 are placed outside the heat exchange unit 50 in this manner, thus enabling an appropriate separation of the inside of the heat exchange unit from the outside, except for the openings 55*a*, 56*a* in the first and second gap portions 55, 56. In addition, the corner support members 38 are placed in the vicinity of the respective corner ridge members 30, and the reinforcement members 31*b* of the end walls 31 are fixed to the corner support members 38 by means of bolts 39 so as to come into contact with the inner plates 31*a*. Then, the reinforcement members 34 of the first walls 32 and the reinforcement members 37 of the second walls 35 are fixed, through the inner plates 33, 36, to the corner support members 38 and the reinforcement members 31*b* of the second walls by means of bolts 39, thus providing a finished outer shell for the heat exchanger.

The end wall 31, the first wall 32 and the second wall 35 for forming the outer shell for the heat exchanger 3 have the respective combined structure of the inner plates 31*a*, 33, 36 formed of a thin plate and the reinforcement members 31*b*, 34, 37 that are placed outside these inner plates and have a sufficient strength. It is therefore possible to weld easily the inner plates 31*a*, 33, 36 to the respective corner ridge members 30 and the other plates. Any desired material can be used as the reinforcement members 31*b*, 34, 37, without taking account whether or not it is weldable to the heat exchange unit. The different material from the heat exchange plates 51 may be used as material for forming the reinforcement members 31*b*, 34, 37. Selection of an appropriate material having a sufficient strength, an excellent corrosion resistance to the heat exchange fluids and a low cost permits to reduce costs for the whole heat exchanger 3.

According to the heat exchanger 3, a proper setting of position and size of the holes 37*a*, 37*b* on the reinforcement members 37 of the second walls provides an easy and flexible design in setting of the inlet and outlet for the heat exchange fluids, thus permitting to cope with heat exchange systems for different use. The flanges 34*c*, 37*d* fixed firmly to the reinforcement members 34, 37 are used to install actually the heat exchanger 3 and connect the pipes for supplying and discharging the heat exchange fluids, thus enhancing the support strength and facilitating the connection operation.

In the heat exchanger 3, the heat exchange fluid is caused to flow in the first gap portions 55 through the holes 34*a*, the central openings 33*a* and the respective openings 55*a* and the other heat exchange fluid is caused to flow in the second gap portions 56 of the heat exchange unit 50 through the holes 37*a*, 37*b*, the central openings 36*a* and the respective openings 56*a*, so as to make heat exchange between the two kinds of heat exchange fluids. The other heat exchange fluid is caused to flow from the hole 37*a* at the longitudinal end of the heat exchange unit 50 to the hole 37*b* at the other longitudinal end thereof in the same manner as the first and second embodiments of the present invention, thus making it possible to cause the other heat exchange fluid to flow in the vertical direction in the second gap portions 56. The other heat exchange fluid flowing in the second gap portions 56 and the heat exchange fluid flowing in the vertical direction in the first gap portions 55 on the opposite side of the heat exchange fluid relative to the heat exchange plate 51 provide a flowing relationship based on a parallel flowing system or a counter-flowing system.

In use of the heat exchanger 3, pressure from the heat exchange fluid is applied to the heat exchange unit 50, the end walls 31, the first walls 32 and the second walls 35. However, there is recognized no deformation due to the pressure in the heat exchange unit 50 in the same manner as the first and second embodiments of the present invention, thus enabling an appropriate separation of the gap portions 55, 56 of the heat exchange unit 50 to be ensured. Further, the end walls 31, the first walls 32 and the second walls 35 have the combined structure in which the welded inner plates 31*a*, 33, 36 are supported by the reinforcement members 31*b*, 34, 37 that are connected from the outside to the inner plates, thus causing neither deformation nor displacement and enabling an appropriate separation of the gap portions 55, 56 from the outside to be ensured.

The first wall 32 and the second wall 35 are composed of the inner plates 33, 36 having the framework shape, which is welded to the heat exchange unit 50, and the reinforcement members 24, which are placed outside the inner plates 33, 36 and has a sufficient strength, and the reinforcement members 34, 37 are detachable from the inner plates 33, 36. It is therefore possible to expose the openings 55*a*, 56*a* with the size of the central openings 33*a*, 36*a* of the respective inner plates 33, 36 in a state in which the reinforcement members 34, 37 are removed, thus forming a sufficiently wide opening on the respective planes of the heat exchange unit 50, from which the heat exchange plates 51 are exposed to the outside. This makes it possible to carry out appropriately maintenance operations such as a cleaning operation of the heat exchange plates 51, without disassembling the heat exchange unit 50. There is therefore provided not only a strong structure having an excellent pressure-resistant property by the welding operation, but also an excellent serviceability. Especially, it is possible to provide the inner plate 36 of the second wall 35 with the central opening 36*a* having an extremely wide opening area. It is therefore possible to remove the reinforcement members 37 to carry out appropriate maintenance operations through the central opening 36*a*, thus providing a remarkably extended service life of the heat exchanger 3, even when the heat exchange fluid flowing in the second gap portion 56 is something such as seawater, which may damage the heat exchange plates 51 due to use of the heat exchanger 3 for a predetermined period of time.

According to the outer shell structure of the third embodiment of the present invention, the second wall 35 is composed of the inner plate 36 welded to the corner ridge member 30 and the reinforcement member 37 having a sufficient strength, provided outside the inner plate 36, so as to divide the wall into a member that is connected to the heat exchange unit 50 and another member that is provided with the inlet and outlet for the heat exchange fluid. The reinforcement member 37 having the inlet and outlet is detachable from the inner plate 36, thus making it possible to apply the welding operation only to the inner plate 36, for connection to the corner ridge member 30 and the end wall 31. Combination of these members enables a thin plate with consideration given only to a required minimum strength to be used as the inner plate 36, thus leading to an easy operation for connecting the thin plate to the corner ridge member 30 and the end wall 31. The combined structure in which the reinforcement member 37 is secured to the inner plate 36, provides a high strength to prevent deformation caused by pressure of the heat exchange fluids, thus ensuring a reliable separation not only between the passages for the fluids, but also between these passages and the outside. In addition, when the reinforcement member 37 is removed from the inner plate 36, it is possible to expose the opening 56*a* with the size of the central opening 36*a* of the inner plate 36, thus forming a sufficiently wide opening on the respective planes of the heat exchange unit 50, from which the heat exchange plates are exposed to the outside. This makes it possible to carry out appropriately maintenance operations such as a cleaning operation of the heat exchange plates. Further, it is possible to place the inlet and outlet for the heat exchange fluids flowing through the second gap portions 56 on predetermined position on the ends of the heat exchanger 3 in accordance with a position of the openings 37*a*, 37*b* of the reinforcement member 37, thus improving degree of freedom in design of the heat exchanger and providing excellent effects in general versatility.

In the outer shell structure according to the third embodiment of the present invention, the corner support members 38 that are placed in the vicinity of the corner ridge members 30 are utilized to connect the respective reinforcement members 31*b*, 34, 37 of the end wall 31, the first wall 32 and the second wall 35 to the heat exchange unit 50. However, the present invention is not limited only to such an embodiment. The reinforcement members 31*b*, 34, 37 may be connected to each other by means of bolts, without utilizing any corner support member 38.

In the outer shell structure according to the first to third embodiments of the present invention, the holes 13*a*, 24*a*, 34*a* communicating with the first gap portions 55 of the heat exchange unit 50 are placed on the longitudinal opposite sides of the heat exchanger, the holes 16*a*, 26*a*, 37*a*, 37*b* communicating with the second gap portions 56 are placed on the longitudinal side thereof so that the other heat exchange fluid also flows in the vertical direction in the second gap portions 56, thus providing a flowing relationship based on a parallel flowing system or a counter-flowing system between the heat exchange fluid flowing in the vertical direction in the first gap portions 55 and the above-mentioned other heat exchange fluid. However, the present invention is not limited only to such embodiments. Each of the second walls 35 may be provided with a single hole serving as the inlet and outlet for the heat exchange fluid, which is located in the center of the wall and has a predetermined size, or a plurality of holes, which are located symmetrically with respect to the center of the wall so that the other heat exchange fluid flows in the lateral direction in the second gap portions 56, thus providing a cross flowing system in which flowing directions of these fluids flow along the opposite surfaces of the heat exchange plate 51 intersect.

In the outer shell structure according to the first to third embodiments of the present invention, each of the end walls 11, 21, 31, the first walls 12, 22, 32 and the second walls 15, 25, 35 has the combined structure of the inner plate and the reinforcement member. However, the present invention is not limited only to such embodiments. Each of the end wall, the first wall and the second wall may be composed of a single plate having a predetermined strength. In case where the heat exchanger is kept in a specific condition in which a large amount of cover material of fluid or a solid having flowability comes into contact with the entire outer peripheral surface of the heat exchanger to apply uniformly the corresponding pressure to that of the heat exchange fluid thereto or the heat exchanger is surrounded with a hard cover material which is not deformed by the pressure of the heat exchange fluid, a thin plate with consideration given only to the required minimum strength may be used as the end wall, the first wall and the second wall.

In the outer shell structure according to the first to third embodiments of the present invention, the reinforcement members having a large thickness are connected at the ends thereof by means of the bolts, when the reinforcement members are fixed to the outer surfaces of the inner plates of the end walls 11, 21, 31, the first walls 12, 22, 32 and the second walls 15, 25, 35. In addition, the reinforcement members may be provided with projections and recesses, which are to be engaged directly with each other. For example, the reinforcement member of the end wall may be provided at the ends thereof with the projections, and the reinforcement members of the first wall and the second wall may be provided with the recesses with which the above-mentioned projections engage. Engagement of the projections with the recesses provides higher connection strength of the connection structure of the reinforcement members. As a result, the engagement of the projections with the recesses prevents the reinforcement members from being moved outward in an improper manner to provide a deformation prevention effect of the inner plates by the reinforcement members, thus enabling an appropriate separation of the heat exchanger from the outside to be ensured.

What is claimed is:

1. An outer shell structure for a heat exchanger, with which a heat exchange unit having a plurality of heat exchange plates formed of a square or rectangular metallic plate is surrounded, said heat exchange plates being placed in parallel with each other so that there are repeated a first connecting relationship in which external surfaces of adjacent two heat exchange plates face each other and welded together at a first pair of side edges thereof over an entire length thereof to form a first gap portion therebetween and a second connecting relationship in which internal surfaces of other adjacent two heat exchange plates face each other and welded together at a second pair of side edges thereof rectangular to said first pair of side edges over an entire length thereof excepting welded portions of the first pair of side edges to form a second gap portion therebetween, so as to provide a combined body for the heat exchange unit, having a pair of first opposite planes that are in parallel with the heat exchange plates, a pair of second opposite planes that are placed on opening sides of said first gap portion and a pair of third opposite planes that are placed on opening sides of said second gap portion, said outer shell structure ensuring separate flow of a first heat exchange fluid flowing through said first gap portion and a second heat exchange fluid flowing through said second gap portion and preventing external leakage of the first and second heat exchange fluids, said outer shell structure comprising:

a pair of opposite end walls placed on the pair of first opposite planes of the heat exchange unit, respectively, so as to cover the pair of first opposite planes thereof;

a pair of opposite first walls with an opening placed outside apart from the pair of second opposite planes of the heat exchange unit, respectively, said first walls being connected water-tightly to edges of said end walls so as to isolate an opening of said first gap portion from an outside, except for an inlet and an outlet for said first heat exchange fluid;

a pair of opposite second walls with an opening placed outside apart from the pair of third opposite planes of the heat exchange unit, respectively, said second walls being connected water-tightly to edges of said end walls so as to isolate an opening of said second gap portion from the outside, except for an inlet and an outlet for said second heat exchange fluid;

one or more gap closure members for closing a gap between said second walls and said heat exchange unit, other than regions of the inlet and outlet for the second heat exchange fluid, to prevent the heat exchange fluid from flowing in a direction along which the gap portion extends, in parallel with a side of the heat exchange plates;

four sets of corner ridge members welded to the opposite end walls and the heat exchange plates, each of said corner ridge members comprising an outer plate section and an inner plate section, each of said outer and inner plate sections being provided at a longitudinal side thereof with a serration portion having serrations that are formed at same intervals as the heat exchange plates aligned with a same orientation of said plurality of heat exchange plates, said serration portion of said outer plate section being inserted into gaps between a plural pairs of heat exchange plates that are welded together at said first pair of side edges thereof over the entire length thereof, of said heat exchange unit, and said serration portion of said inner plate section being inserted into the openings of the first gap portions by a predetermined length; and said end walls being connected water-tightly to opposite end portions of each of said corner ridge members in a direction along which the heat exchange plates are placed.

2. The outer shell structure as claimed in claim 1, wherein:

each of said end walls comprises an inner plate and a reinforcement member, said inner plate having a larger size than said first opposite planes of the heat exchange unit, said inner plate being welded at edges thereof water-tightly to said corner ridge members, said first walls and said second walls, said reinforcement member being formed of a plate having a size, which is identical to or larger than said inner plate, said reinforcement member having a predetermined strength, which prevents the reinforcement member from being deformed by pressure applied by the heat exchange fluid, said reinforcement member being kept in a state in which the reinforcement member is placed on said inner plate so as to come into contact with said inner plate from an outside thereof.

3. The outer shell structure as claimed in claim 1, wherein:

each of said first walls comprises an inner plate and a reinforcement member, said inner plate being provided in a form of a rectangular or square framework having a central opening that is substantially a same as said second opposite planes of said heat exchange unit, said inner plate being welded water-tightly at a peripheral portion of the central opening to the inner plate section of each of the corner ridge members and said end walls, said reinforcement member being formed of a plate having a size, which is identical to or larger than said inner plate, said reinforcement member having a predetermined strength, which prevents the reinforcement member from being deformed by pressure applied by the heat exchange fluid, said reinforcement member being kept in a state in which the reinforcement member is detachably placed on said inner plate so as to come water-tightly into contact with said inner plate from an outside thereof, said reinforcement member having one or more openings at a position corresponding to the central opening of the inner plate;

said one or more openings of said reinforcement member and a part of said central opening of said inner plate, which corresponds to said one or more openings form said inlet and outlet for the heat exchange fluids.

4. The outer shell structure as claimed in claim 1, wherein:

each of said second walls comprises an inner plate and a reinforcement member, said inner plate being provided in a form of a rectangular or square framework having a central opening that is substantially a same as said third opposite planes of said heat exchange unit, said inner plate being welded water-tightly at a peripheral portion of the central opening to the outer plate section of each of the corner ridge members and said end walls, said reinforcement member being formed of a plate having a size, which is identical to or larger than said inner plate, said reinforcement member having a predetermined strength, which prevents the reinforcement member from being deformed by pressure applied by the heat exchange fluid, said reinforcement member being kept in a state in which the reinforcement member is detachably placed on said inner plate so as to come water-tightly into contact with said inner plate from an outside thereof, said reinforcement member having one or more openings at a position corresponding to the central opening of the inner plate;

said one or more openings of said reinforcement member and a part of said central opening of said inner plate, which corresponds to said one or more openings form said inlet and outlet for the heat exchange fluids.

5. The outer shell structure as claimed in claim 1, wherein:

each of said second walls comprises an inner plate and a reinforcement member, said inner plate being placed in parallel with said third opposite planes of said heat exchange unit, said inner plate being welded water-tightly at opposite parallel sides thereof to edges of said end walls and at at least one of other opposite parallel sides thereof to the corner ridge members placed on both sides of said third opposite planes of said heat exchange unit, said inner plate having one or more openings communicating with the opening of said second gap portion, said reinforcement member being formed of one or more rectangular plates having a predetermined strength, which prevents the plate from being deformed by pressure applied by the heat exchange fluid, so as to provide, alone or in combination with each other, a same size as or a larger size than said inner plate, said reinforcement member being placed water-tightly on said inner plate from an outside thereof in a state in which through-holes through which said one or more openings of said inner plate communicate with the outside in a position corresponding to the openings thereof;

said one or more openings of said inner plate form said inlet and outlet for the heat exchange fluids.

6. The outer shell structure as claimed in claim 1, wherein:

each of said second walls comprises one or more inner plates and a reinforcement member, said inner plate being placed in parallel with said third opposite planes of said heat exchange unit, said inner plate being welded water-tightly at opposite parallel sides thereof to at least edges of said end walls and said reinforcement member being formed of a rectangular plate having a same size as or a larger size than said inner plate and a predetermined strength, which prevents the plate from being deformed by pressure applied by the heat exchange fluid, said reinforcement member being placed water-tightly on said inner plate from an outside thereof;

said inner plate causing at least one of other opposite parallel sides thereof perpendicular to said opposite parallel sides thereof to be placed along said third opposite planes of said heat exchange unit so as to form openings between at least one of said other opposite parallel sides and the corner ridge members placed on said third opposite planes of said heat exchange or edges of the inner plate;

said reinforcement member keeping said openings in a released state in which the openings communicate with the outside;

said openings form said inlet and outlet for the heat exchange fluids.

7. The outer shell structure as claimed in claim 5, wherein:

said inner plate causes one of said other opposite parallel sides thereof to be placed along said third opposite planes of said heat exchange unit so as to form other openings between the one of said other opposite parallel sides and a closer one of the corner ridge members placed on said third opposite planes of said heat exchange unit;

said reinforcement member keeping said other openings in a released state in which the other openings communicate with the outside.

8. An outer shell structure for a heat exchanger, with which a heat exchange unit having a plurality of heat exchange plates formed of a square or rectangular metallic plate is surrounded, said heat exchange plates being placed in parallel with each other so that there are repeated a first connecting relationship in which external surfaces of adjacent two heat exchange plates face each other and welded together at a first pair of side edges thereof over an entire length thereof to form a first gap portion therebetween and a second connecting relationship in which internal surfaces of other adjacent two heat exchange plates face each other and welded together at a second pair of side edges thereof rectangular to said first pair of side edges over an entire length thereof excepting welded portions of the first pair of side edges to form a second gap portion therebetween, so as to provide a combined body for the heat exchange unit, having a pair of first opposite planes that are in parallel with the heat exchange plates, a pair of second opposite planes that are placed on opening sides of said first gap portion and a pair of third opposite planes that are placed on opening sides of said second gap portion, said outer shell structure ensuring separate flow of a first heat exchange fluid flowing through said first gap portion and a second heat exchange fluid flowing through said second gap portion and preventing external leakage of the first and second heat exchange fluids, said outer shell structure comprising:

a pair of opposite end walls placed on the pair of first opposite planes of the heat exchange unit, respectively, so as to cover the pair of first opposite planes thereof;

a pair of opposite first walls with an opening placed outside apart from the pair of second opposite planes of the heat exchange unit, respectively, said first walls being connected water-tightly to edges of said end walls so as to isolate an opening of said first gap portion from an outside, except for an inlet and an outlet for said first heat exchange fluid;

a pair of opposite second walls with an opening placed outside apart from the pair of third opposite planes of the heat exchange unit, respectively, said second walls being connected water-tightly to edges of said end walls so as to isolate an opening of said second gap portion from the outside, except for an inlet and an outlet for said second heat exchange fluid;

one or more gap closure members for closing a gap between said second walls and said heat exchange unit, other than regions of the inlet and outlet for the second heat exchange fluid, to prevent the heat exchange fluid from flowing in a direction along which the gap portion extends, in parallel with a side of the heat exchange plates, wherein the inlet of said inlet and outlet for said second heat exchange fluid, which communicate with the second gap portions, is placed on a side of one of said first walls on at least one of said second walls, and the outlet thereof is placed on a side of another of said first walls on at least one of said second walls.

9. The outer shell structure as claimed in claim 2, wherein:

each of said first walls comprises an inner plate and a reinforcement member, said inner plate being provided in a form of a rectangular or square framework having a central opening that is substantially a same as said second opposite planes of said heat exchange unit, said inner plate being welded water-tightly at a peripheral portion of the central opening to the inner plate section of each of the corner ridge members and said end walls, said reinforcement member being formed of a plate having a size, which is identical to or larger than said inner plate, said reinforcement member having a predetermined strength, which prevents the reinforcement member from being deformed by pressure applied by the heat exchange fluid, said reinforcement member being kept in a state in which the reinforcement member is detachably placed on said inner plate so as to come water-tightly into contact with said inner plate from an outside thereof, said reinforcement member having one or more openings at a position corresponding to the central opening of the inner plate;

said one or more openings of said reinforcement member and a part of said central opening of said inner plate, which corresponds to said one or more openings form said inlet and outlet for the heat exchange fluids.

10. The outer shell structure as claimed in claim 2, wherein:

each of said second walls comprises an inner plate and a reinforcement member, said inner plate being provided in a form of a rectangular or square framework having a central opening that is substantially a same as said third opposite planes of said heat exchange unit, said inner plate being welded water-tightly at a peripheral portion of the central opening to the outer plate section of each of the corner ridge members and said end walls, said reinforcement member being formed of a plate having a size, which is identical to or larger than said inner plate, said reinforcement member having a predetermined strength, which prevents the reinforcement member from being deformed by pressure applied by the heat exchange fluid, said reinforcement member being kept in a state in which the reinforcement member is detachably placed on said inner plate so as to come water-tightly into contact with said inner plate from an outside thereof, said reinforcement member having one or more openings at a position corresponding to the central opening of the inner plate;

said one or more openings of said reinforcement member and a part of said central opening of said inner plate, which corresponds to said one or more openings form said inlet and outlet for the heat exchange fluids.

11. The outer shell structure as claimed in claim 9, wherein:

each of said second walls comprises an inner plate and a reinforcement member, said inner plate being provided in a form of a rectangular or square framework having a central opening that is substantially a same as said third opposite planes of said heat exchange unit, said inner plate being welded water-tightly at a peripheral portion of the central opening to the outer plate section of each of the corner ridge members and said end walls, said reinforcement member being formed of a plate having a size, which is identical to or larger than said inner plate, said reinforcement member having a predetermined strength, which prevents the reinforcement member from being deformed by pressure applied by the heat exchange fluid, said reinforcement member being kept in a state in which the reinforcement member is detachably placed on said inner plate so as to come water-tightly into contact with said inner plate from an outside thereof, said reinforcement member having one or more openings at a position corresponding to the central opening of the inner plate;

said one or more openings of said reinforcement member and a part of said central opening of said inner plate, which corresponds to said one or more openings form said inlet and outlet for the heat exchange fluids.

12. The outer shell structure as claimed in claim 2, wherein:

each of said second walls comprises an inner plate and a reinforcement member, said inner plate being placed in parallel with said third opposite planes of said heat exchange unit, said inner plate being welded water-tightly at opposite parallel sides thereof to edges of said end walls and at at least one of other opposite parallel sides thereof to the corner ridge members placed on both sides of said third opposite planes of said heat exchange unit, said inner plate having one or more openings communicating with the opening of said second gap portion, said reinforcement member being formed of one or more rectangular plates having a predetermined strength, which prevents the plate from being deformed by pressure applied by the heat exchange fluid, so as to provide, alone or in combination with each other, a same size as or a larger size than said inner plate, said reinforcement member being placed water-tightly on said inner plate from an outside thereof in a state in which through-holes through which said one or more openings of said inner plate communicate with the outside in a position corresponding to the openings thereof;

said one or more openings of said inner plate form said inlet and outlet for the heat exchange fluids.

13. The outer shell structure as claimed in claim 9, wherein:

each of said second walls comprises an inner plate and a reinforcement member, said inner plate being placed in parallel with said third opposite planes of said heat exchange unit, said inner plate being welded water-tightly at opposite parallel sides thereof to edges of said end walls and at at least one of other opposite parallel sides thereof to the corner ridge members placed on both sides of said third opposite planes of said heat exchange unit, said inner plate having one or more openings communicating with the opening of said second gap portion, said reinforcement member being formed of one or more rectangular plates having a predetermined strength, which prevents the plate from being deformed by pressure applied by the heat exchange fluid, so as to provide, alone or in combination with each other, a same size as or a larger size than said inner plate, said reinforcement member being placed water-tightly on said inner plate from an outside thereof in a state in which through-holes through which said one or more openings of said inner plate communicate with the outside in a position corresponding to the openings thereof;

said one or more openings of said inner plate form said inlet and outlet for the heat exchange fluids.

14. The outer shell structure as claimed in claim 2, wherein:

each of said second walls comprises one or more inner plates and a reinforcement member, said inner plate being placed in parallel with said third opposite planes of said heat exchange unit, said inner plate being welded water-tightly at opposite parallel sides thereof to at least edges of said end walls and said reinforcement member being formed of a rectangular plate having a same size as or a larger size than said inner plate and a predetermined strength, which prevents the plate from being deformed by pressure applied by the heat exchange fluid, said reinforcement member being placed water-tightly on said inner plate from an outside thereof;

said inner plate causing at least one of other opposite parallel sides thereof perpendicular to said opposite parallel sides thereof to be placed along said third opposite planes of said heat exchange unit so as to form openings between at least one of said other opposite parallel sides and the corner ridge members placed on said third opposite planes of said heat exchange or edges of the inner plate;

said reinforcement member keeping said openings in a released state in which the openings communicate with the outside;

said openings form said inlet and outlet for the heat exchange fluids.

15. The outer shell structure as claimed in claim 9, wherein:

each of said second walls comprises one or more inner plates and a reinforcement member, said inner plate being placed in parallel with said third opposite planes of said heat exchange unit, said inner plate being welded water-tightly at opposite parallel sides thereof to at least edges of said end walls and said reinforcement member being formed of a rectangular plate having a same size as or a larger size than said inner plate and a predetermined strength, which prevents the plate from being deformed by pressure applied by the heat exchange fluid, said reinforcement member being placed water-tightly on said inner plate from an outside thereof;

said inner plate causing at least one of other opposite parallel sides thereof perpendicular to said opposite parallel sides thereof to be placed along said third opposite planes of said heat exchange unit so as to form openings between at least one of said other opposite parallel sides and the corner ridge members placed on said third opposite planes of said heat exchange or edges of the inner plate;

said reinforcement member keeping said openings in a released state in which the openings communicate with the outside;

said openings form said inlet and outlet for the heat exchange fluids.

16. The outer shell structure as claimed in claim 12, wherein:

said inner plate causes one of said other opposite parallel sides thereof to be placed along said third opposite planes of said heat exchange unit so as to form other openings between the one of said other opposite parallel sides and a closer one of the corner ridge members placed on said third opposite planes of said heat exchange unit;

said reinforcement member keeping said other openings in a released state in which the other openings communicate with the outside.

17. The outer shell structure as claimed in claim 13, wherein:

said inner plate causes one of said other opposite parallel sides thereof to be placed along said third opposite planes of said heat exchange unit so as to form other openings between the one of said other opposite parallel sides and a closer one of the corner ridge members placed on said third opposite planes of said heat exchange unit;

said reinforcement member keeping said other openings in a released state in which the other openings communicate with the outside.

18. The outer shell structure as claimed in claim 13, wherein:

the inlet of said inlet and outlet for said second heat exchange fluid, which communicate with the second gap portions, is placed on a side of one of said first walls on at least one of said second walls, and the outlet thereof is placed on a side of another of said first walls on at least one of said second walls.

* * * * *